US012114820B2

(12) United States Patent
Nguyen et al.

(10) Patent No.: US 12,114,820 B2
(45) Date of Patent: Oct. 15, 2024

(54) SURFACE CLEANING APPARATUS

(71) Applicant: BISSELL INC., Grand Rapids, MI (US)

(72) Inventors: Tom Minh Nguyen, Grand Rapids, MI (US); David M. Miller, Zealand, MI (US); Michael D. Graham, Lake Odessa, MI (US); YunMing Huang, Shenzhen (CN); Chiu Yeung Lee, Hong Kong (HK)

(73) Assignee: BISSELL Inc., Grand Rapids, MI (US)

( * ) Notice: Subject to any disclaimer, the term of this patent is extended or adjusted under 35 U.S.C. 154(b) by 56 days.

(21) Appl. No.: 18/091,823

(22) Filed: Dec. 30, 2022

(65) Prior Publication Data

US 2023/0134611 A1 May 4, 2023

Related U.S. Application Data

(63) Continuation of application No. 17/380,384, filed on Jul. 20, 2021, which is a continuation of application
(Continued)

(51) Int. Cl.
*A47L 11/40* (2006.01)
*A47L 7/00* (2006.01)
(Continued)

(52) U.S. Cl.
CPC ..... *A47L 11/4083* (2013.01); *A47L 7/0028* (2013.01); *A47L 11/20* (2013.01);
(Continued)

(58) Field of Classification Search
CPC .... A47L 11/4083; A47L 7/0028; A47L 11/34; A47L 11/4016; A47L 11/4027; A47L 11/4041; A47L 11/4044; A47L 11/4088
See application file for complete search history.

(56) References Cited

U.S. PATENT DOCUMENTS 4,159,554 A * 7/1979 Knight ..... A47L 11/4016 D32/32
5,406,673 A * 4/1995 Bradd ..... A47L 11/40 15/320

(Continued)

FOREIGN PATENT DOCUMENTS

GB 2285573 A 7/1995
GB 2408674 A 6/2005
GB 2522434 A 7/2015

OTHER PUBLICATIONS

Hoover Power Path Pro User Manual—2014 (Year: 2014).*

(Continued)

*Primary Examiner* — Marc Carlson
(74) *Attorney, Agent, or Firm* — Quinn IP Law

(57) ABSTRACT

A surface cleaning apparatus includes a recovery tank, a suction nozzle in fluid communication with the recovery tank, and a suction source in fluid communication with the suction nozzle and the recovery tank to generate a working air path to transport debris-containing fluid including air and liquid from the suction nozzle into the recovery tank. An air/liquid separator can be provided within the recovery tank for separating liquid from air in the debris-containing fluid.

19 Claims, 16 Drawing Sheets

Related U.S. Application Data

No. 16/232,548, filed on Dec. 26, 2018, now Pat. No. 11,089,935, which is a continuation of application No. 15/263,960, filed on Sep. 13, 2016, now Pat. No. 10,188,252.

(60) Provisional application No. 62/218,231, filed on Sep. 14, 2015.

(51) Int. Cl.
*A47L 11/20* (2006.01)
*A47L 11/30* (2006.01)
*A47L 11/34* (2006.01)

(52) U.S. Cl.
CPC ..... *A47L 11/201* (2013.01); *A47L 11/302* (2013.01); *A47L 11/34* (2013.01); *A47L 11/4013* (2013.01); *A47L 11/4016* (2013.01); *A47L 11/4027* (2013.01); *A47L 11/4041* (2013.01); *A47L 11/4044* (2013.01); *A47L 11/4055* (2013.01); *A47L 11/4088* (2013.01)

(56) References Cited

U.S. PATENT DOCUMENTS 5,735,017 A * 4/1998 Barnes ..... A47L 11/4027 15/328
5,761,763 A * 6/1998 McAllise ..... A47L 11/4061 15/353
6,134,744 A * 10/2000 Kasen ..... A47L 11/03 15/328
6,286,180 B1 * 9/2001 Kasper ..... A47L 11/30 15/320
6,591,447 B2 * 7/2003 Wegelin ..... A47L 5/34 15/361
6,957,473 B2 * 10/2005 Nishikori ..... A47L 9/0081 15/351
7,073,226 B1 * 7/2006 Lenkiewicz ..... A47L 11/4083 15/327.2
RE39,304 E * 9/2006 Kasen ..... A47L 5/32 15/368
7,685,671 B2 * 3/2010 Jansen ..... A47L 9/325 15/328
7,784,148 B2 * 8/2010 Lenkiwicz ..... A47L 11/34 15/322
9,138,119 B1 * 9/2015 Bantum ..... A47L 11/4088
2002/0026683 A1 * 3/2002 Kasper ..... A47L 11/34 15/320
2002/0092116 A1 * 7/2002 Zahuranec ..... A47L 11/4083 15/320
2003/0226228 A1 * 12/2003 Symensma ..... A47L 11/34 15/353
2003/0226230 A1 * 12/2003 Hertrick ..... A47L 11/4008 15/320
2004/0134016 A1 * 7/2004 Kisela ..... A47L 9/2842 15/403
2005/0120507 A1 * 6/2005 Kegg ..... A47L 11/4027 15/320
2006/0123586 A1 * 6/2006 Wegelin ..... A47L 11/4083 15/320
2007/0094838 A1 * 5/2007 Zahuranec ..... A47L 5/225 15/328
2007/0226943 A1 * 10/2007 Lenkiewicz ..... A47L 11/302 15/320
2009/0276975 A1 * 11/2009 Vines ..... A47L 11/4044 15/347
2012/0304416 A1 * 12/2012 Nguyen ..... A47L 11/202 705/500
2013/0318741 A1 * 12/2013 Moyher, Jr. ..... A47L 9/0027 15/327.1
2015/0216385 A1 * 8/2015 Bantum ..... A47L 11/4088 15/322
2015/0374190 A1 * 12/2015 Bantum ..... A47L 11/34 15/320
2016/0331197 A1 * 11/2016 Burnham ..... A47L 9/24
2017/0071434 A1 * 3/2017 Nguyen ..... A47L 11/4027
2019/0142238 A1 * 5/2019 Nguyen ..... A47L 11/4041 15/320
2021/0045611 A1 * 2/2021 Nguyen ..... A47L 11/302

OTHER PUBLICATIONS

Hoover Power Path Pro Advanced User Manual, 2014.
Hoover Max Extract Dual V Carpet Cleaner User's Manual, Jul. 2011.
Hoover Max Extract Dual V Carpet Cleaner YouTube Video, Feb. 10, 2014, retrieved from: https://www.youtube.com/watch?v=9yln2li83Ck.
Hoover Power Path Pro Advanced YouTube Video, May 12, 2015, Retrieved from: https://www.youtube.com/watch?v=LKKpGz1_dRI.
Rhodri Evans, Patents Act 1977: Search Report Under Section 17(6), 4 pages, Feb. 10, 2017, South Wales.
Rhodri Evans, Patents Act 1977: Search Report Under Section 17(5), 2 pages, Aug. 18, 2017, South Wales.

* cited by examiner

SURFACE CLEANING APPARATUS

CROSS-REFERENCE TO RELATED APPLICATION(S)

This application is a continuation of U.S. patent application Ser. No. 17/380,384, filed Jul. 20, 2021, which is a continuation of U.S. patent application Ser. No. 16/232,548, filed Dec. 26, 2018, now U.S. Pat. No. 11,089,935, which is a continuation of U.S. patent application Ser. No. 15/263,960, filed Sep. 13, 2016, now U.S. Pat. No. 10,188,252, which claims the benefit of U.S. Provisional Patent Application No. 62/218,231, filed Sep. 14, 2015, each of which is incorporated herein by reference in its entirety.

BACKGROUND

Extraction cleaners are well-known surface cleaning apparatuses for deep cleaning carpets and other fabric surfaces, such as upholstery. Most carpet extractors comprise a fluid delivery system that delivers cleaning fluid to a surface to be cleaned and a fluid recovery system that extracts spent cleaning fluid and debris (which may include dirt, dust, stains, soil, hair, and other debris) from the surface. The fluid delivery system typically includes one or more fluid supply tanks for storing a supply of cleaning fluid, a fluid distributor for applying the cleaning fluid to the surface to be cleaned, and a fluid supply conduit for delivering the cleaning fluid from the fluid supply tank to the fluid distributor. An agitator can be provided for agitating the cleaning fluid on the surface. The fluid recovery system usually comprises a recovery tank, a nozzle adjacent the surface to be cleaned and in fluid communication with the recovery tank through a working air conduit, and a source of suction in fluid communication with the working air conduit to draw the cleaning fluid from the surface to be cleaned and through the nozzle and the working air conduit to the recovery tank. Other surface cleaning apparatuses include vacuum cleaners, which can have a nozzle adjacent the surface to be cleaned in fluid communication with a collection system and an agitator can be provided for agitating the cleaning fluid on the surface.

BRIEF DESCRIPTION

An aspect of the present disclosure relates to a surface cleaning apparatus, comprising a housing, a working air path through the housing, a recovery container defining a portion of the working air path, a suction source defining a portion of the working air path, and a hose defining an airflow conduit and having a first end and a second end, spaced from the first end, a hose coupler provided at the first end, the hose coupler comprising a coupler housing having an inlet airflow connector, a hose receiver adapted to receive the hose coupler, the hose receiver comprising a hose port in fluid communication with a portion of the working air path upstream of the recovery container and the suction source, wherein the hose port is adapted to couple with the inlet airflow connector such that the airflow conduit of the hose is in fluid communication with a portion of the working air path; and a locking mechanism adapted to retain the hose coupler in the hose receiver, wherein the locking mechanism comprises at least one locking projection engageable with at least one locking latch.

DETAILED DESCRIPTION

Figure 1:
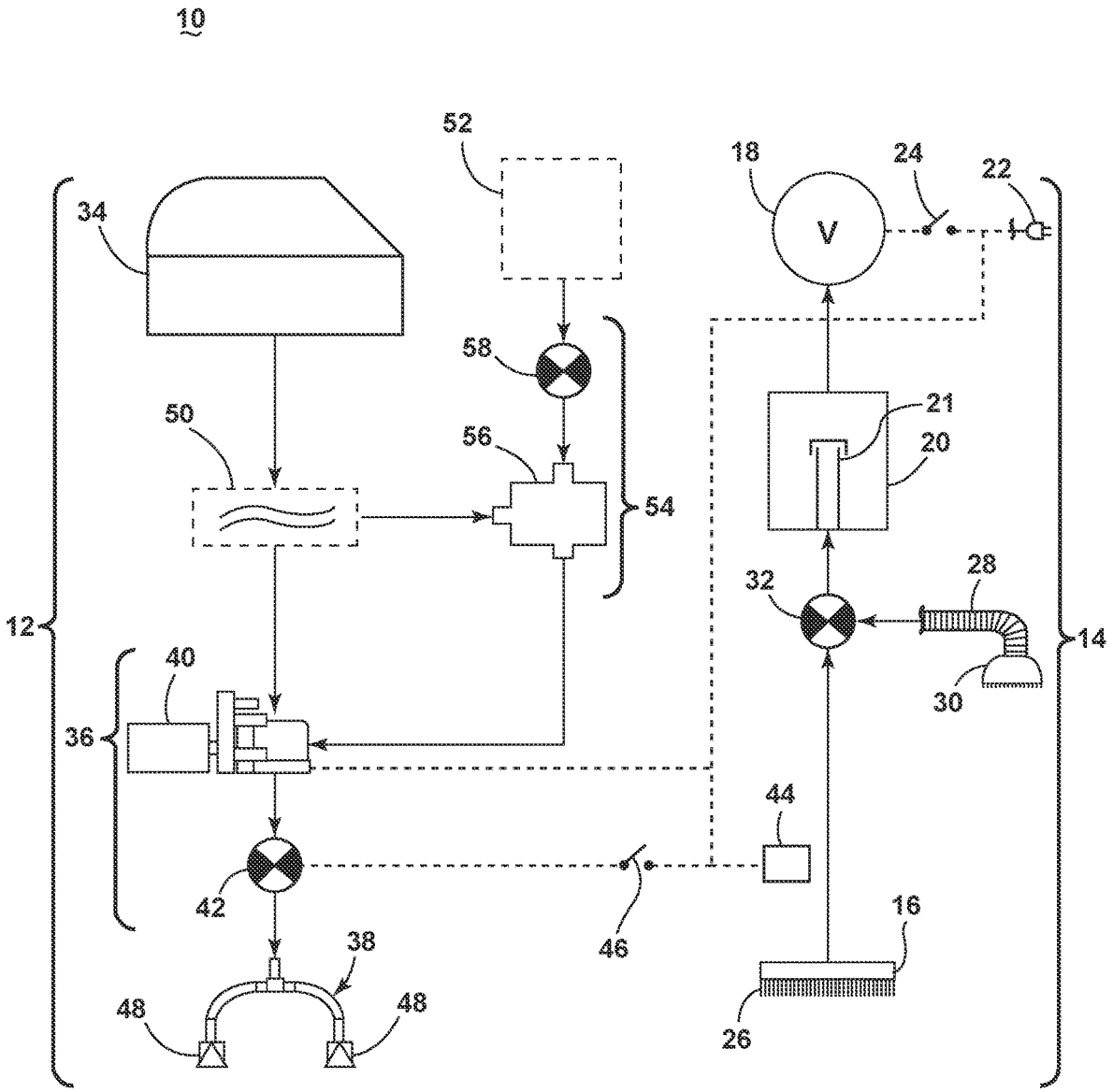
FIG. 1 is a schematic view of a surface cleaning apparatus in the form of an extraction cleaner.

FIG. 1 is a schematic view of various functional systems of a surface cleaning apparatus in the form of an extraction cleaner 10. The functional systems of the extraction cleaner 10 can be arranged into any desired configuration, such as an upright extraction device having a base and an upright body for directing the base across the surface to be cleaned, a canister device having a cleaning implement connected to a wheeled base by a vacuum hose, a portable extractor adapted to be hand carried by a user for cleaning relatively small areas, or a commercial extractor. Any of the aforementioned extraction cleaners can be adapted to include a flexible vacuum hose, which can form a portion of the working air conduit between a nozzle and the suction source.

The extraction cleaner 10 can include a fluid delivery system 12 for storing cleaning fluid and delivering the cleaning fluid to the surface to be cleaned and a recovery system 14 for removing the spent cleaning fluid and debris from the surface to be cleaned and storing the spent cleaning fluid and debris.

The recovery system 14 can include a suction nozzle 16, a suction source 18 in fluid communication with the suction nozzle 16 for generating a working air stream, and a recovery container 20 for separating and collecting fluid and debris from the working airstream for later disposal. A separator 21 can be formed in a portion of the recovery container 20 for separating fluid and entrained debris from the working airstream.

The suction source 18, such as a motor/fan assembly, is provided in fluid communication with the recovery container 20. The motor/fan assembly 18 can be electrically coupled to a power source 22, such as a battery or by a power cord plugged into a household electrical outlet. A suction power switch 24 between the motor/fan assembly 18 and the power source 22 can be selectively closed by the user, thereby activating the motor/fan assembly 18.

The suction nozzle 16 can be provided on a base or cleaning head adapted to move over the surface to be cleaned. An agitator 26 can be provided adjacent to the suction nozzle 16 for agitating the surface to be cleaned so that the debris is more easily ingested into the suction nozzle 16. Some examples of agitators include, but are not limited to, a horizontally-rotating brushroll, dual horizontally-rotating brushrolls, one or more vertically-rotating brushrolls, or a stationary brush.

The extraction cleaner 10 can also be provided with above-the-floor cleaning features. A vacuum hose 28 can be selectively fluidly coupled to the motor/fan assembly 18 for above-the-floor cleaning using an above-the floor cleaning tool 30 with its own suction inlet. A diverter assembly 32 can be selectively switched between on-the-floor and above-the floor cleaning by diverting fluid communication between either the suction nozzle 16 or the vacuum hose 28 with the motor/fan assembly 18.

The fluid delivery system 12 can include at least one fluid container 34 for storing a supply of fluid. The fluid can comprise one or more of any suitable cleaning fluids, including, but not limited to, water, compositions, concentrated detergent, diluted detergent, etc., and mixtures thereof. For example, the fluid can comprise a mixture of water and concentrated detergent.

The fluid delivery system 12 can further comprise a flow control system 36 for controlling the flow of fluid from the container 34 to a fluid distributor 38. In one configuration, the flow control system 36 can comprise a pump 40 which pressurizes the system 12 and a flow control valve 42 which controls the delivery of fluid to the distributor 38. An actuator 44 can be provided to actuate the flow control system 36 and dispense fluid to the distributor 38. The actuator 44 can be operably coupled to the valve 42 such that pressing the actuator 44 will open the valve 42. The valve 42 can be electrically actuated, such as by providing an electrical switch 46 between the valve 42 and the power source 22 that is selectively closed when the actuator 44 is pressed, thereby powering the valve 42 to move to an open position. In one example, the valve 42 can be a solenoid valve. The pump 40 can also be coupled with the power source 22. In one example, the pump 40 can be a centrifugal pump. In another example, the pump 40 can be a solenoid pump.

The fluid distributor 38 can include at least one distributor outlet 48 for delivering fluid to the surface to be cleaned. The at least one distributor outlet 48 can be positioned to deliver fluid directly to the surface to be cleaned, or indirectly by delivering fluid onto the agitator 26. The at least one distributor outlet 48 can comprise any structure, such as a nozzle or spray tip; multiple outlets 48 can also be provided. As illustrated in FIG. 1, the distributor 38 can comprise two spray tips 48 which distribute cleaning fluid to the surface to be cleaned. For above-the-floor cleaning, the cleaning tool 30 can include an auxiliary distributor (not shown) coupled with the fluid delivery system 12.

Optionally, a heater 50 can be provided for heating the cleaning fluid prior to delivering the cleaning fluid to the surface to be cleaned. In the example illustrated in FIG. 1, an in-line heater 50 can be located downstream of the container 34 and upstream of the pump 40. Other types of heaters 50 can also be used. In yet another example, the cleaning fluid can be heated using exhaust air from a motor-cooling pathway for the motor/fan assembly 18.

As another option, the fluid delivery system can be provided with an additional container 52 for storing a cleaning fluid. For example the first container 34 can store water and the second container 52 can store a cleaning agent such as detergent. The containers 34, 52 can, for example, be defined by a supply tank and/or a collapsible bladder. In one configuration, the first container 34 can be a bladder that is provided within the recovery container 20. Alternatively, a single container can define multiple chambers for different fluids.

In the case where multiple containers 34, 52 are provided, the flow control system 36 can further be provided with a mixing system 54 for controlling the composition of the cleaning fluid that is delivered to the surface. The composition of the cleaning fluid can be determined by the ratio of cleaning fluids mixed together by the mixing system. As shown herein, the mixing system 54 includes a mixing manifold 56 that selectively receives fluid from one or both of the containers 34, 52. A mixing valve 58 is fluidly coupled with an outlet of the second container 52, whereby when mixing valve 58 is open, the second cleaning fluid will flow to the mixing manifold 56. By controlling the orifice of the mixing valve 58 or the time that the mixing valve 58 is open, the composition of the cleaning fluid that is delivered to the surface can be selected.

In yet another configuration of the fluid delivery system 12, the pump 40 can be eliminated and the flow control system 36 can comprise a gravity-feed system having a valve fluidly coupled with an outlet of the container(s) 34, 52, whereby when valve is open, fluid will flow under the force of gravity to the distributor 38. The valve can be mechanically actuated or electrically actuated, as described above.

The extraction cleaner 10 shown in FIG. 1 can be used to effectively remove debris and fluid from the surface to be cleaned in accordance with the following method. The sequence of steps discussed is for illustrative purposes only and is not meant to limit the method in any way as it is understood that the steps may proceed in a different logical order, additional or intervening steps may be included, or described steps may be divided into multiple steps.

In operation, the extraction cleaner 10 is prepared for use by coupling the extraction cleaner 10 to the power source 22, and by filling the first container 34, and optionally the second container 52, with cleaning fluid. Cleaning fluid is selectively delivered to the surface to be cleaned via the fluid delivery system 12 by user-activation of the actuator 44, while the extraction cleaner 10 is moved back and forth over the surface. The agitator 26 can simultaneously agitate the cleaning fluid into the surface to be cleaned. During operation of the recovery system 14, the extraction cleaner 10 draws in fluid and debris-laden working air through the suction nozzle 16 or cleaning tool 30, depending on the position of the diverter assembly 32, and into the downstream recovery container 20 where the fluid debris is substantially separated from the working air. The airstream then passes through the motor/fan assembly 18 prior to being exhausted from the extraction cleaner 10. The recovery container 20 can be periodically emptied of collected fluid and debris.

Figure 2:
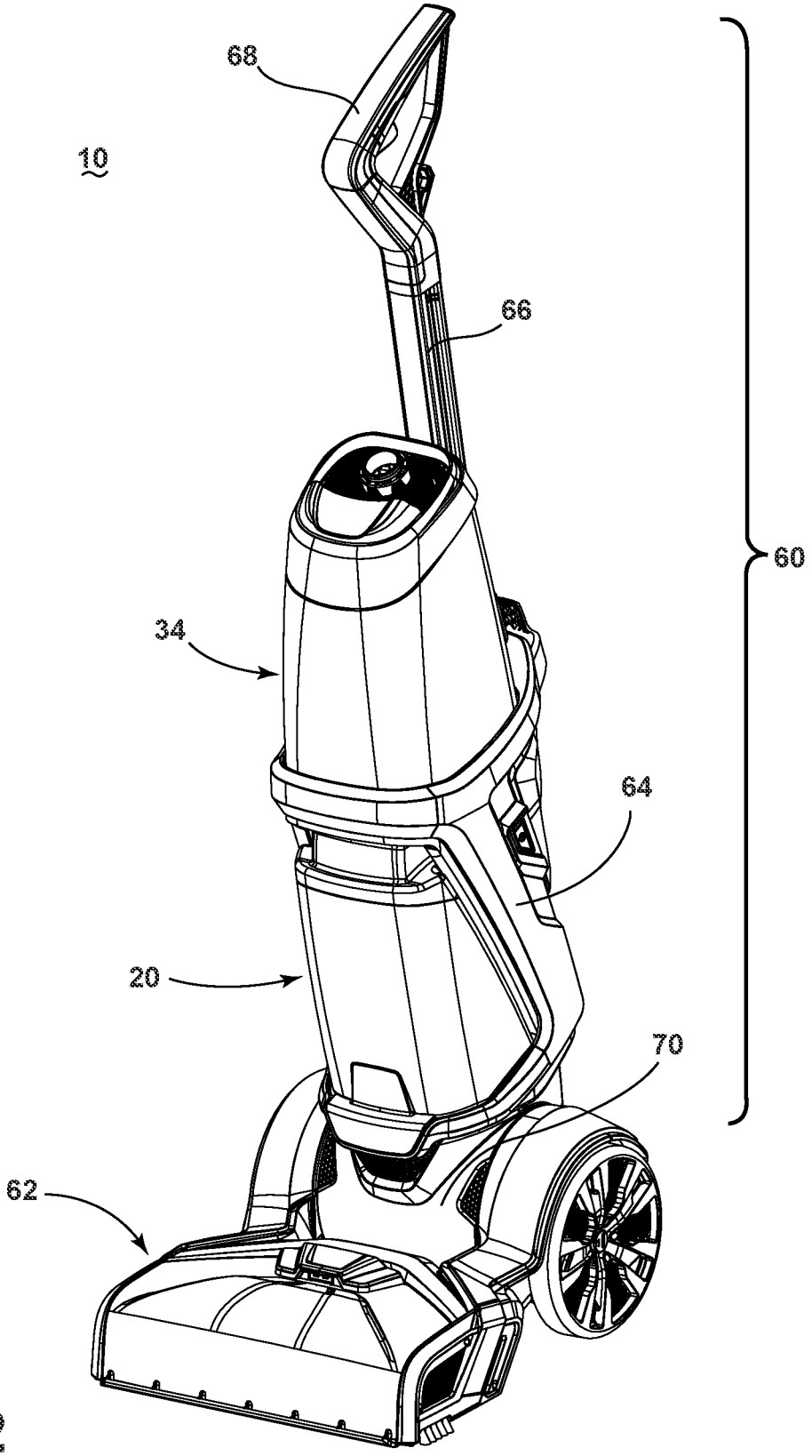
FIG. 2 is a perspective view of an extraction cleaner according to various aspects described herein.

FIG. 2 is a perspective view illustrating one non-limiting example of an extraction cleaner 10, according to another aspect of the disclosure. As illustrated herein, the extraction cleaner 10 is an upright extraction cleaner having a housing that includes an upright assembly 60 that is pivotally connected to a base assembly 62 for directing the base assembly 62 across the surface to be cleaned. The extraction cleaner 10 can comprise the various systems and components schematically described for FIG. 1, including the fluid delivery system 12 for storing and delivering a cleaning fluid to the surface to be cleaned and the recovery system 14 for extracting and storing the dispensed cleaning fluid, dirt and debris from the surface to be cleaned. The various systems and components schematically described for FIG. 1, including the fluid delivery system 12 and fluid recovery system 14 can be supported by either or both the base assembly 62 and the upright assembly 60.

For purposes of description related to the figures, the terms "upper," "lower," "right," "left," "rear," "front," "vertical," "horizontal," "inner," "outer," and derivatives thereof shall relate to the surface cleaning apparatus or components thereof as oriented in FIG. 2 from the perspective of a user behind the extraction cleaner 10, which defines the rear of the extraction cleaner 10. However, it is to be understood that the disclosure may assume various alternative orientations, except where expressly specified to the contrary.

The upright assembly 60 includes a main support section or frame 64 supporting components of the fluid delivery system 12 and the recovery system 14, including, but not limited to, the recovery container 20 and the fluid container 34. The upright assembly 60 also has an elongated handle 66 extending upwardly from the frame 64 that is provided with a hand grip 68 at one end that can be used for maneuvering the extraction cleaner 10 over a surface to be cleaned. A motor housing 70 is formed at a lower end of the frame 64 and contains the motor/fan assembly 18 (FIG. 1) positioned therein in fluid communication with the recovery container 20.

Figure 3:
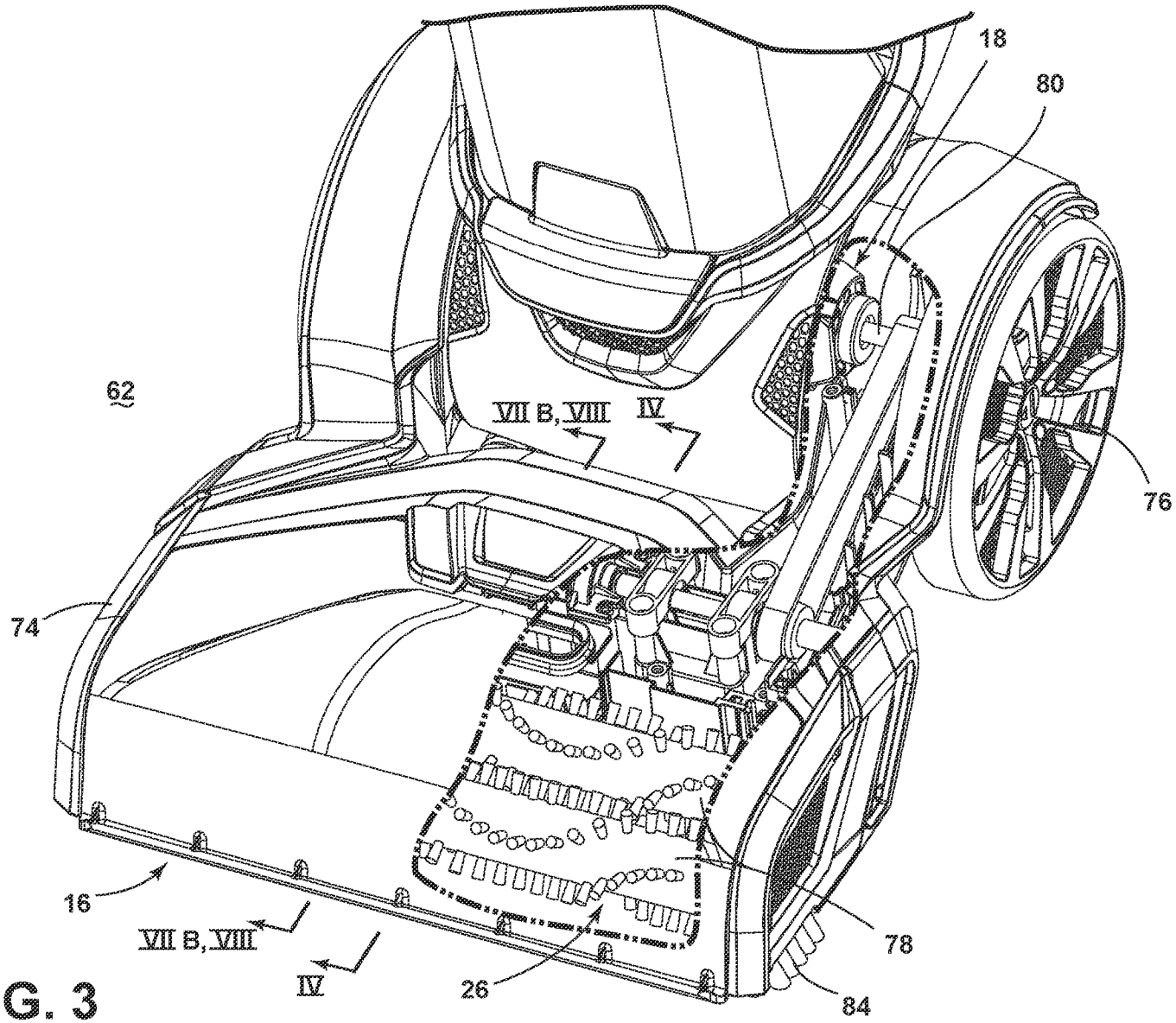
FIG. 3 is a perspective view of a base assembly of the extraction cleaner of FIG. 2, with a portion of the base assembly cut away to show some internal features of the base assembly.

FIG. 3 is a perspective view of the base assembly 62 of the extraction cleaner 10 from FIG. 2. In FIG. 3, a portion of the base assembly 62 is cut away to show some internal features of the base assembly 62. The base assembly 62 includes a base housing 74 supporting components of the fluid delivery system 12 and the recovery system 14, including, but not limited to, the suction nozzle 16, the agitator 26, the pump 40, and the fluid distributor 38. Wheels 76 at least partially support the base housing 74 for movement over the surface to be cleaned.

The agitator 26 of the illustrated example includes dual horizontally-rotating brushrolls 78 which are operatively coupled with a drive shaft 80 of the motor/fan assembly 18 via a transmission 82, which can include one or more belts, gears, shafts, pulleys, or combinations thereof. The pump 40 may also be operatively coupled with a drive shaft 80 of the motor/fan assembly 18 via the transmission 82, or via its own transmission. An additional agitator in the form of stationary edge brushes 84 may also be provided on the base housing 74.

The fluid distributor 38 includes a conduit 86 that supplies cleaning fluid from the fluid container 34 to a spray bar 88 having a plurality of distributor outlets 48. The distributor outlets 48 dispense cleaning fluid between the brushrolls 78. The conduit 86 can extend from the base assembly 62 to the fluid container 34 in the upright assembly 60, and may be made up of one or more flexible and/or rigid sections. The pump 40 may form a portion of the conduit 86.

Figure 4:
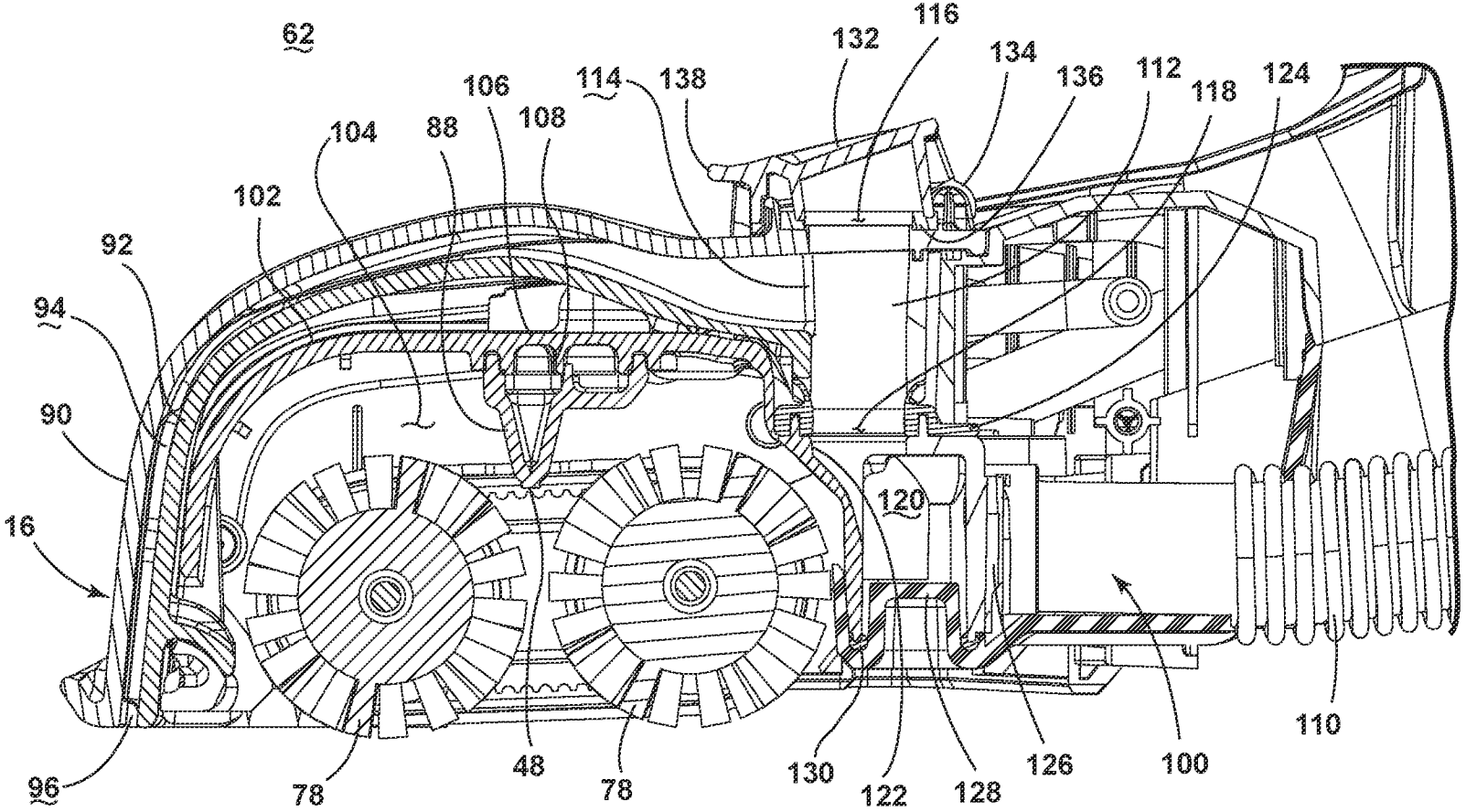
FIG. 4 is a cross-sectional view of the base assembly through line IV-IV of FIG. 3.

FIG. 4 is a cross-sectional view through line IV-IV of FIG. 3. The suction nozzle 16 of the extraction cleaner 10 can include a front wall 90 and a rear wall 92 defining a narrow suction pathway 94 therebetween with an opening forming a suction nozzle inlet 96 adjacent the surface to be cleaned. The suction pathway 94 is in fluid communication with a recovery airflow conduit 100 leading to the recovery container 20. The suction nozzle 16 can be configured to be removable as a unit from the base assembly 62, with the front and rear walls 90, 92 fixedly attached together in a non-separable configuration. For example, the front and rear walls 90, 92 can be welded together.

An agitator housing 102 is provided beneath the suction nozzle 16 and defines an agitator chamber 104 for the brushrolls 78. The spray bar 88 can be mounted on the agitator housing 102, and a portion of the agitator housing 102 may form a portion of the conduit 86 that supplies cleaning fluid from the fluid container 34 to the spray bar 88. Here the agitator housing 102 may form an upper enclosure 106 for a fluid pathway 108 through the spray bar 88 leading to the distributor outlets 48.

The recovery airflow conduit 100 may be made up of one or more flexible and/or rigid sections, including a hose conduit 110 that passes from the base assembly 62 to the upright assembly 60. The hose conduit 110 can be flexible to facilitate pivoting movement of the upright assembly 60 relative to the base assembly 62.

The extraction cleaner 10 can be provided with a diverter assembly for selectively switching between on-the-floor and above-the floor cleaning by diverting communication between either the suction nozzle 16 or the vacuum hose 28 with the motor/fan assembly 18. The diverter assembly may be provided with the recovery airflow conduit 100 to divert the conduit 100 between communication with the suction nozzle 16 and communication with the vacuum hose 28. The diverter assembly may include a hose receiver 112 defining a portion of the recovery airflow conduit 100 and having a first nozzle port 114 in fluid communication with the suction pathway 94, a hose port 116, and an outlet 118 in selective communication with both ports 114, 116. The nozzle port 114 can define a suction nozzle outlet of suction pathway 94. The hose port 116 can be coupled with the vacuum hose 28, as described in further detail below. The outlet 118 is in fluid communication with the hose conduit 110. A portion of the suction nozzle 16 may be molded to form the hose receiver 112. For example, the hose port 116 can be formed in the front wall 90 and a sidewall of the hose receiver 112 and the outlet 118 can be formed with the rear wall 92.

A portion of the agitator housing 102 may be molded to form a portion of the recovery airflow conduit 100 between the outlet 118 and the hose conduit 110. Here, the agitator housing 102 includes a rigid duct 120 at the rear of the housing 102, rearwardly of the agitator chamber 104. The duct 120 includes an inlet opening 122 that is sealed with the outlet 118 of the hose receiver 112 by a seal 124 for a fluid-tight interface therebetween, and an outlet opening defined by a coupler 126 for the hose conduit 110. The bottom of the duct 120 can be closed by a portion of the base housing 74 to define a bottom 128 of the duct 120, with a seal 130 between a lower edge of the duct 120 and the base housing 74 for a fluid-tight interface therebetween.

A nozzle cover 132 is provided for selectively closing the hose port 116 of the hose receiver 112. The nozzle cover 132 can be mounted to the base housing 74 by a pivot coupling 134 that permits the nozzle cover 132 to pivot between a closed position shown in FIG. 4, and an open position shown in FIG. 5-6. In the closed position, the nozzle cover 132 seals the hose port 116; a seal 136 is provided between the nozzle cover 132 and the suction nozzle 16 to provide a fluid-tight interface. A lip 138 on the front of the nozzle cover 132 can be provided to facilitate raising the nozzle cover 132 away from the suction nozzle 16.

Figure 5:
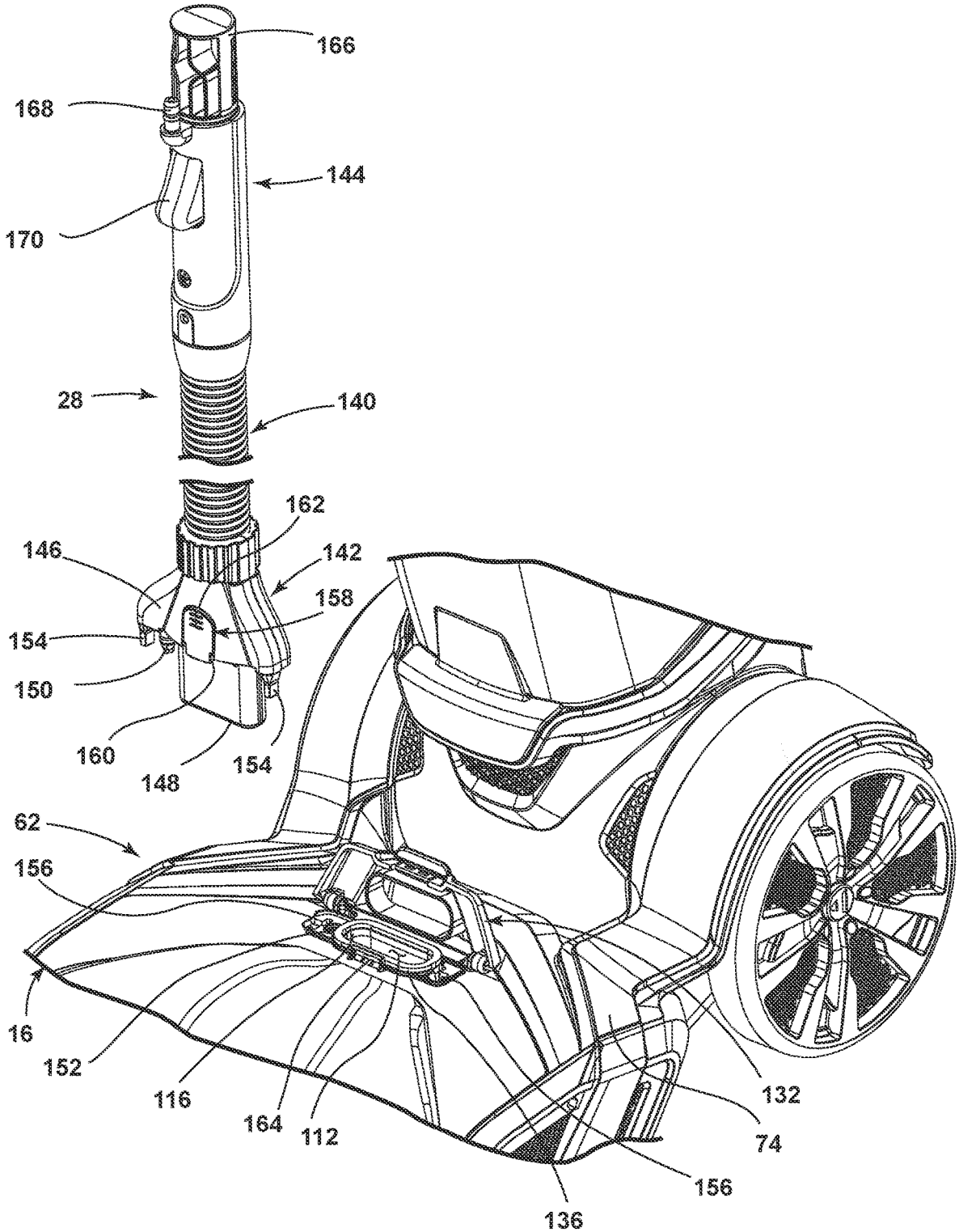
FIG. 5 is a perspective view of a portion of the base assembly and a vacuum hose configured to be coupled with the base assembly.

FIG. 5 is a perspective view of a portion of the base assembly 62 and the vacuum hose 28 configured to be coupled with the base assembly 62. In FIG. 5, the nozzle cover 132 open and ready for insertion of the vacuum hose 28. The vacuum hose 28 is provided with the extraction cleaner 10 for selective use during above-the-floor cleaning. The vacuum hose 28 includes a flexible hose conduit 140, a hose coupler 142 at one end of the hose conduit 140 which couples to the base assembly 62, and a tool coupler 144 at the opposite end of the hose conduit 140 for selectively coupling an accessory tool, such as cleaning tool 30 shown in FIG. 1. Only a portion of the length of the hose conduit 140 is shown in FIG. 5 for clarity, as indicated by the break lines through the hose conduit 140.

The tool coupler 144 defines an inlet of the vacuum hose 28 and the hose coupler 142 defines an outlet of the vacuum hose 28. When the vacuum hose 28 is in use, an opening on an accessory tool coupled with the tool coupler 144 may define a suction inlet for the extraction cleaner 10. The vacuum hose 28 may also be used without an accessory tool, in which case the tool coupler 144 can define the suction inlet for the extraction cleaner 10. The hose conduit 140 can include a hose airflow conduit as well as a hose fluid delivery conduit. The hose airflow conduit is configured to be coupled with the motor/fan assembly 18, and the hose fluid delivery conduit is configured to be coupled with the fluid conduit 34.

The hose coupler 142 includes a housing 146 with an inlet airflow connector 148 of the hose airflow conduit which fluidly and mechanically couples with the hose port 116 of the hose receiver 112 and an inlet fluid connector 150 of the hose fluid delivery conduit which fluidly and mechanically couples with an outlet fluid connector 152 on the base assembly 62 adjacent to the hose port 116. The outlet fluid connector 152 is in fluid communication with the fluid container 34.

The hose coupler 142 includes one or more locking projections 154. The illustrated example includes two locking projections 154 extending from the same side of the housing 146 as the inlet airflow and fluid connectors 148, 150, and spaced on either side of the airflow connector 148. The locking projections 154 engage locking latches 156 provided on the base housing 74, and prevent the suction nozzle 16 from accidentally releasing from the base assembly 62 when the vacuum hose 28 is installed, as described in further detail below.

The hose coupler 142 further includes at least one retention latch 158 for securing the vacuum hose 28 to the base assembly 62. In one configuration illustrated herein, the retention latch 158 can include a hook 160 at one end and a user-engageable tab 162 at an opposite end. The latch 158 can be pivotally mounted on the housing 146 of the hose coupler 142 such that, by pressing or releasing the tab 162, the hook 160 can be pivoted between an unlocked or locked position. A latch retainer 164 is provided on the base assembly 62 for engaging with the hook 160. The latch retainer 164 can comprise a hooked rib on the suction nozzle 16 adjacent to a forward side of the hose port 116. The retention latch 158 can be biased or otherwise configured such that the hook 160 is normally at the inward or locked position. To release the hose coupler 142 from base assembly 62, a user can depress the tab 162 to pivot the hook 160 away from the latch retainer 164 and then pull the vacuum hose 28 away from the base assembly 62.

The tool coupler 144 includes an outlet airflow connector 166 of the hose airflow conduit which is configured to fluidly and mechanically couple with an airflow pathway of an accessory tool leading to a suction inlet of the accessory tool, and an outlet fluid connector 168 of the hose fluid delivery conduit which is configured to fluidly and mechanically couple with an fluid pathway of an accessory tool leading to a fluid dispenser of the accessory tool. The tool coupler 144 can further include a trigger 170 or other actuator for selectively dispensing fluid from the fluid delivery conduit through the fluid connector 168.

Figure 6:
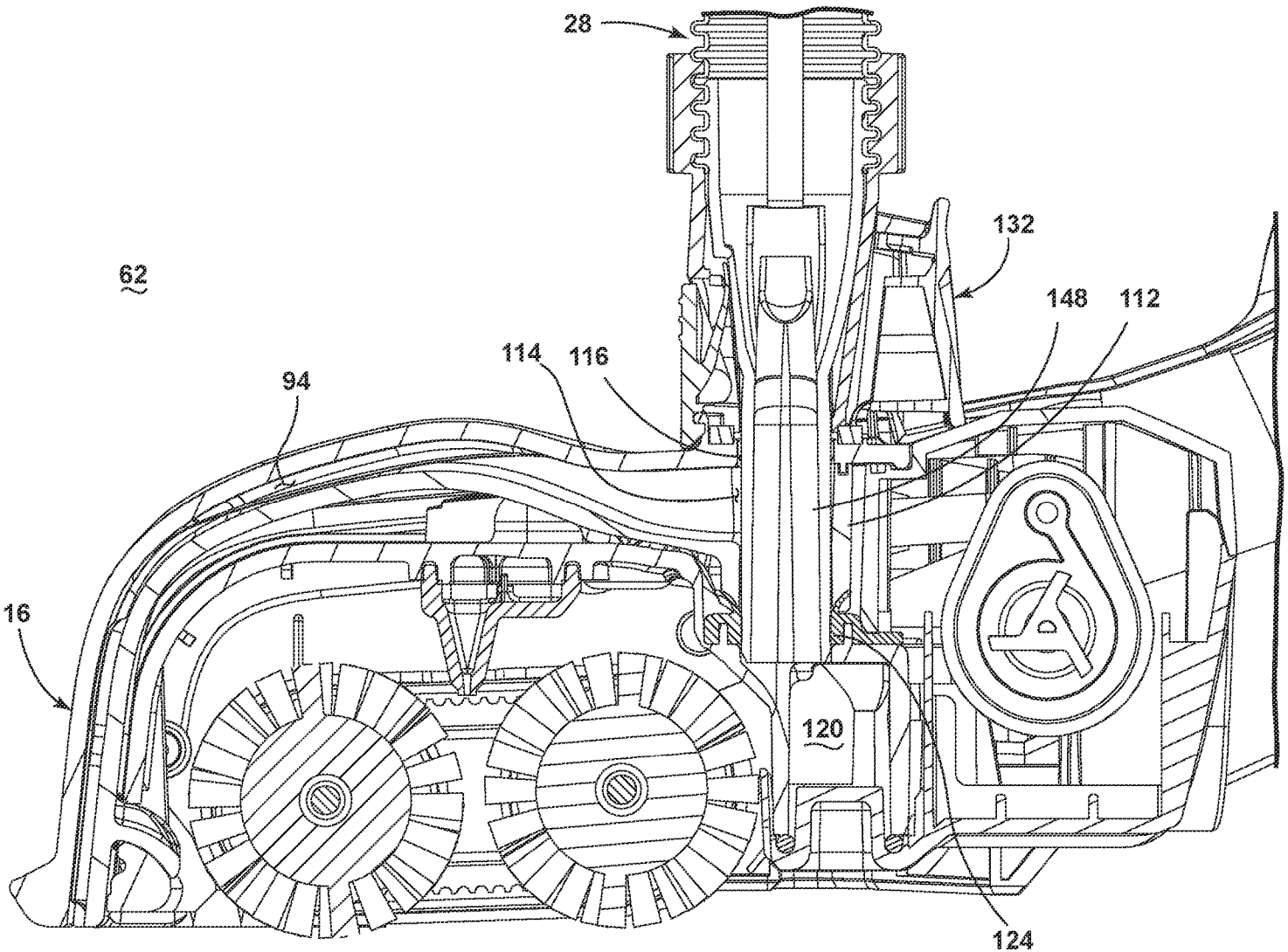
FIG. 6 is a cross-sectional view similar to FIG. 4, but with a nozzle cover in an open position and a vacuum hose attached to the base assembly.

FIG. 6 is a cross-sectional view similar to FIG. 4, but with the nozzle cover 132 in the open position and the vacuum hose 28 attached. The inlet airflow connector 148 is inserted into the hose receiver 112 through the hose port 116. When inserted, the inlet airflow connector 148 blocks the nozzle port 114 and engages with the seal 124 to close off the suction pathway 94 from fluid communication with the motor/fan assembly 18. Thus, no suction is drawn by the suction nozzle 16. Instead, suction is drawn by the vacuum hose 28 through the inlet airflow connector 148.

Figure 7A:
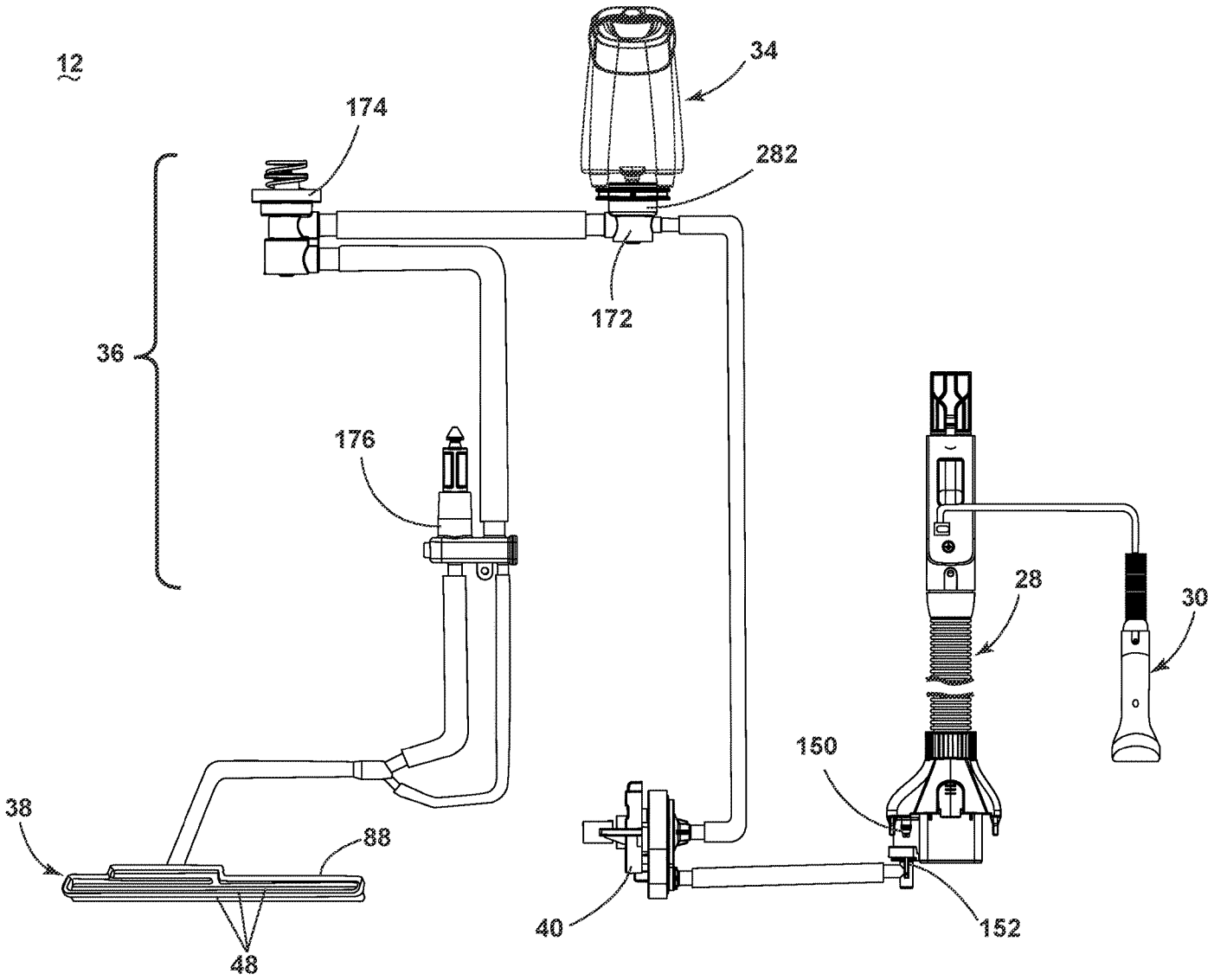
FIG. 7A is a schematic view of the fluid delivery system of the extraction cleaner.

FIG. 7A is a schematic view of the fluid delivery system 12 of the extraction cleaner. The outlet of the fluid container 34 is coupled to a T-connector 172 that feeds the pump 40, which is coupled with the vacuum hose 28, and the spray bar 88, which is gravity-fed. The conduit feeding the spray bar 88 includes flow control system 36, which in this illustrated example includes a valve 174 and a flow controller 176 comprising an adjustable valve that permits varied flow rate operation.

Figure 7B:
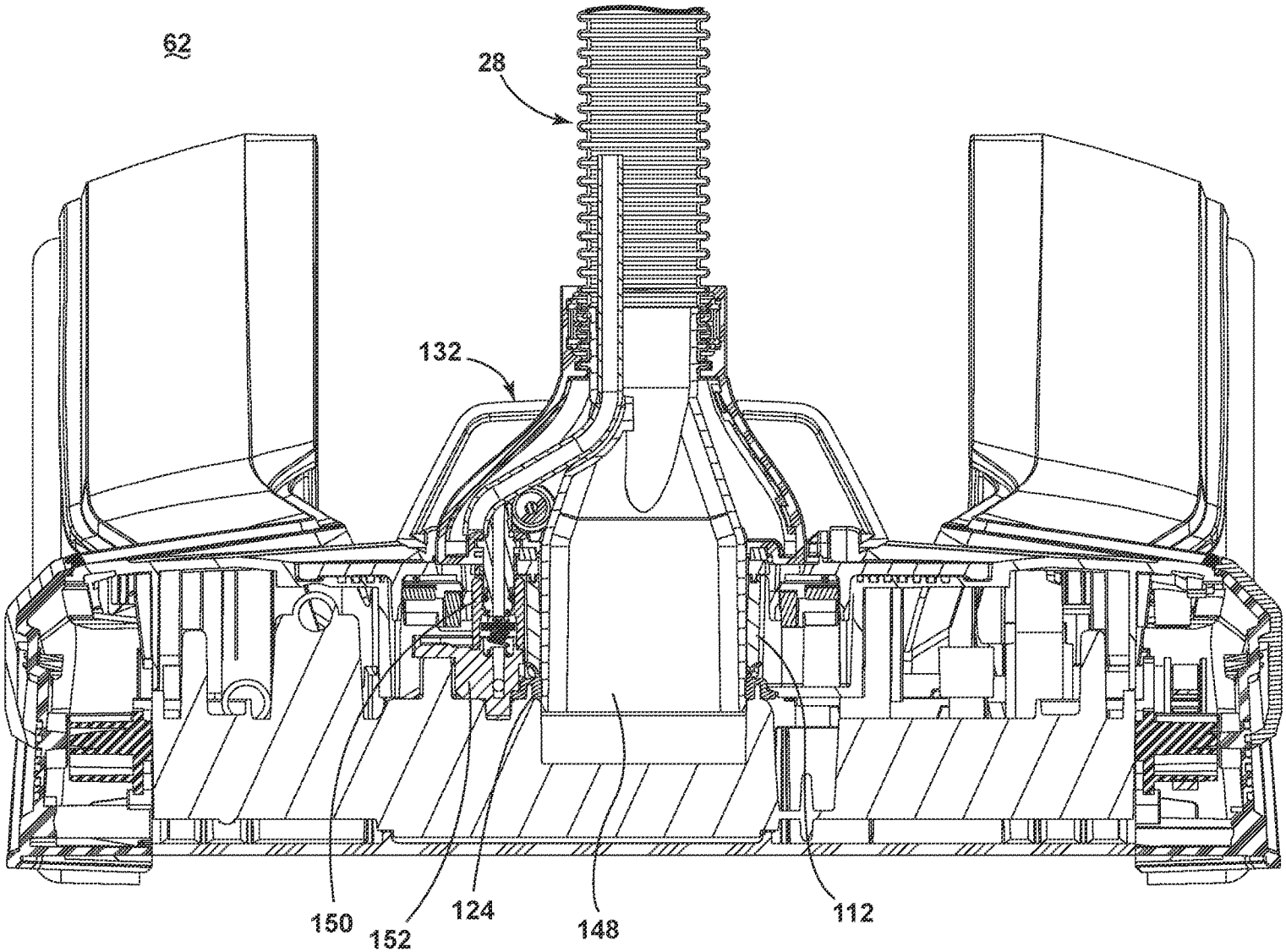
FIG. 7B is a cross-sectional view of the base assembly through line VIIB-VIIB of FIG. 3.

With additional reference to FIG. 7B, which is a cross-sectional view through line VIIB-VIIB of FIG. 3, the pump 40 feeds the outlet fluid connector 152 on the base assembly 62, which includes a normally-closed valve that can be selectively opened by the inlet fluid connector 150 when the vacuum hose 28 is connected to the base assembly 62. When the vacuum hose 28 is not installed, the pump 40, which in this illustrated example is a centrifugal pump, operates in a "dead-head" condition, meaning the pump 40 continues to operate, but fluid is recirculated within the pump 40 whenever the outlet fluid connector 152 is closed.

The airflow and fluid delivery systems of the extraction cleaner 10 can be placed in selective communication with the suction nozzle 16 or the vacuum hose 28 by a user of the extraction cleaner 10. When the extraction cleaner 10 is in an on-the-floor cleaning mode as shown, for example, in FIG. 2, the hose receiver 112 is in fluid communication with the suction nozzle 16 and fluid can be delivered to the spray bar 88. When the extraction cleaner 10 is in an above-the-floor cleaning mode as shown, for example, in FIGS. 6-7, the hose receiver 112 is in fluid communication with the vacuum hose 28 and fluid can be delivered to the vacuum hose 28. When the extraction cleaner 10 is in the on-the-floor cleaning mode, the vacuum hose 28 can be stored separately from the extraction cleaner 10, in other examples a hose mount or other provisions can be made to store on the extraction cleaner 10. One or more cleaning tools 30 (FIG. 1) can be provided for use with the vacuum hose 28 in the above-the-floor cleaning mode.

Figure 8:
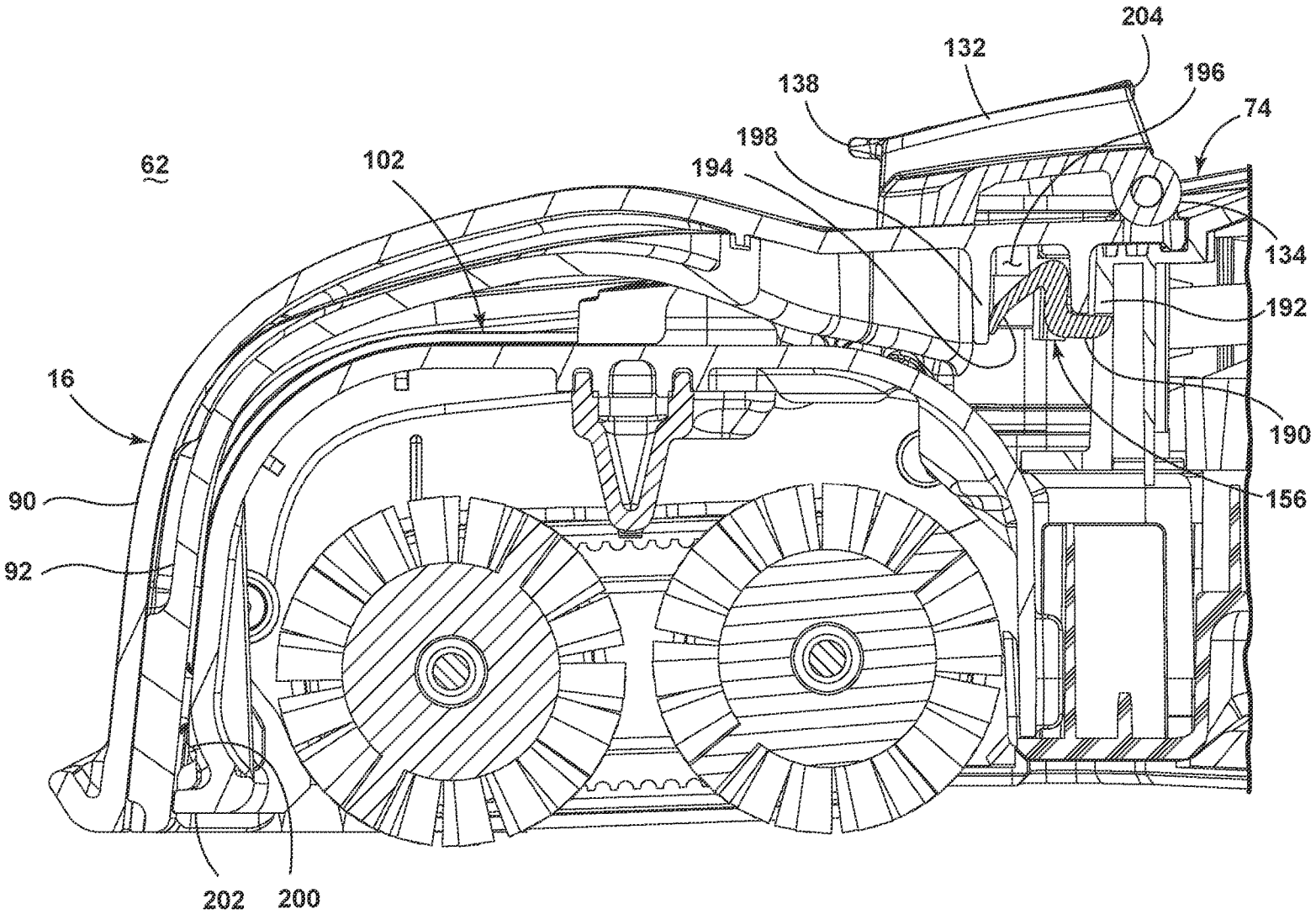
FIG. 8 is a cross-sectional view of the base assembly through line VIII-VIII of FIG. 3.

FIG. 8 is a cross-sectional view of the base assembly 62 through line VIII-VIII of FIG. 3. As briefly described above, the suction nozzle 16 can be configured to be removable as a unit from the base assembly 62. The nozzle cover 132, which is pivoted open to connect the vacuum hose 28, can also be used to release the suction nozzle 16 from the base housing 74. The locking latches 156 provided on the base housing 74 hold the suction nozzle 16 on the base housing 74 and prevent removal of the suction nozzle 16. The locking latches 156 are carried by the suction nozzle 16 and include a retainer 190 which can engage a catch 192 on a portion of the base assembly 62 separate from the suction nozzle 16 and a spring arm 194 which biases the retainer 190 into engagement with the catch 192 in the normal position. The retainer 190 can be hook-shaped and can be in opposing relationship to the spring arm 194. The suction nozzle 16 can include a latch chamber 196 within which the locking latch 156 can be pivotally mounted, with the spring arm 194 slightly flexed by a wall 198 of the latch chamber 196 to engage the retainer 190 in the catch 192. The suction nozzle 16 also includes a forward hook 200 on the rear wall 92 which engages a hook retainer 202 on the front of the agitator housing 102.

Figure 9:
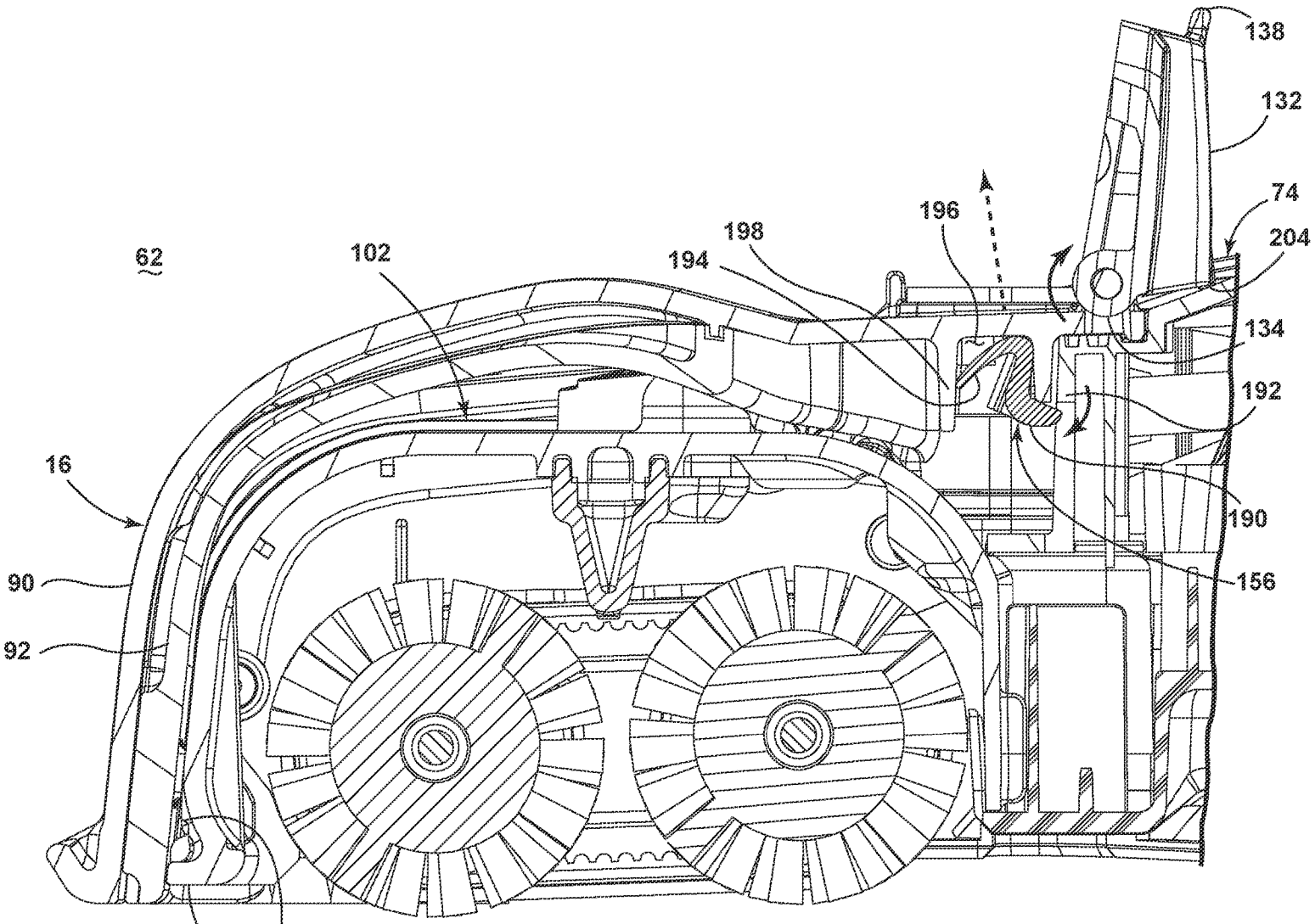
FIG. 9 is a view similar to FIG. 8 showing the operation to remove the suction nozzle.
Figure 10:
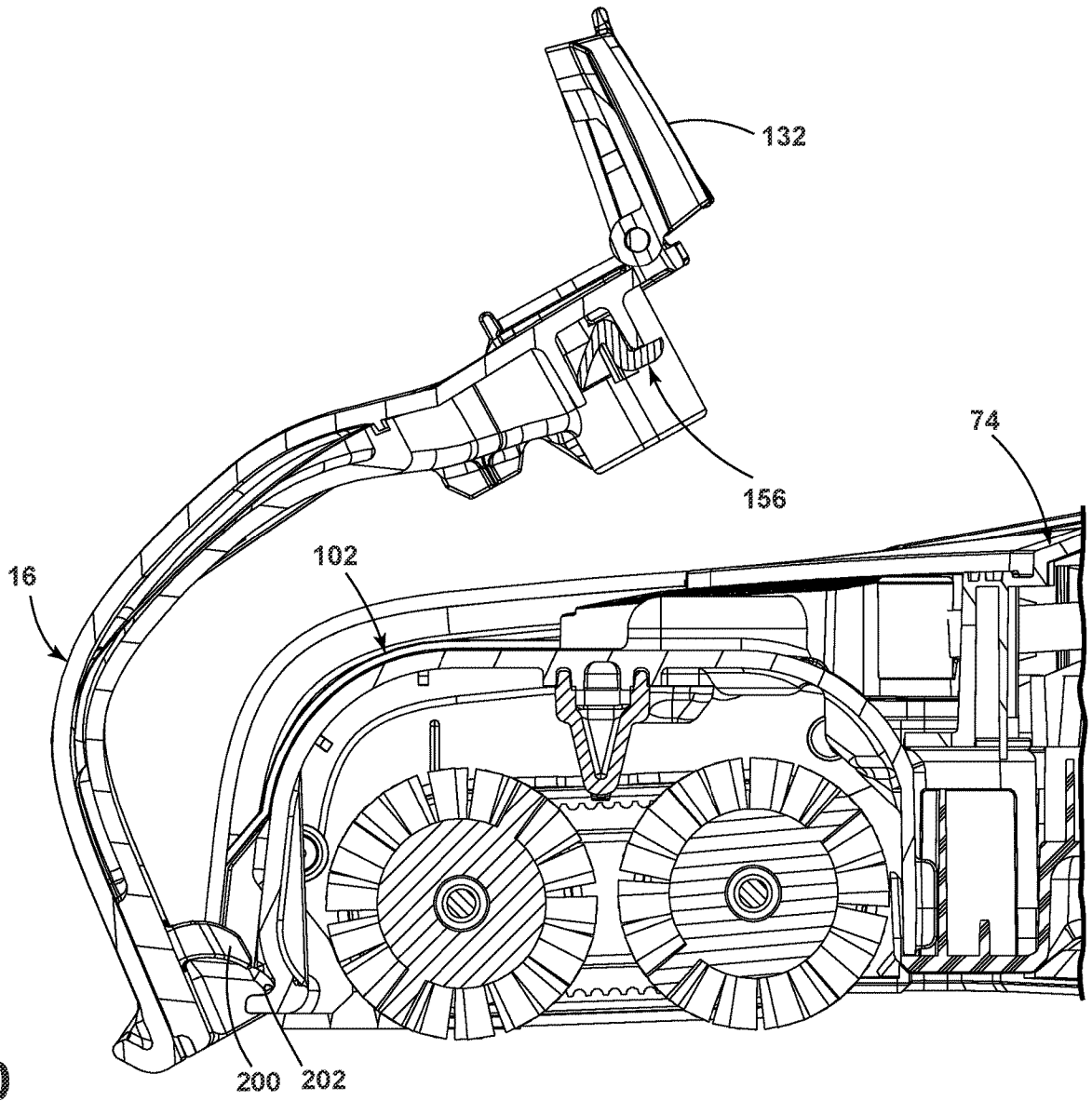
FIG. 10 is a view similar to FIG. 8 showing the operation to remove the suction nozzle.

FIGS. 9-10 are views similar to FIG. 8 showing the operation to remove the suction nozzle 16. The nozzle cover 132 is pivoted open by rotation about the pivot coupling 134. Continued pivoting of the nozzle cover 132 brings a rear edge 204 of the nozzle cover 132 into contact with base housing 74, acting as cam which lifts the rear of the suction nozzle 16 upwardly away from the base housing 74. This lifting action forces the spring arms 194 to deflect and pivots the retainer 190 away from the catch 192 so that the suction nozzle 16 is freed from engagement with the base housing 74, as shown in FIG. 9. The freed suction nozzle 16 can be pivoted forwardly to move the forward hooks 200 of the engagement with the hook retainer 202 and lifted away from the base housing 74 to completely remove the suction nozzle 16 from the base housing 74. During this, the nozzle cover 132 may function as a hand grip for manipulating and carrying the suction nozzle 16.

As described above, the nozzle cover 132 is also pivoted open to connect the vacuum hose 28. As such, when opening the nozzle cover 132 to attach the vacuum hose 28 or during above-the-floor cleaning, the suction nozzle 16 could accidentally be released from the base assembly 62. To address this, the locking projections 154 on the vacuum hose 28 and locking latches 156 form a nozzle latch that prevents the suction nozzle 16 from accidentally releasing from the base assembly 62 when the vacuum hose 28 is installed. The locking projections 154 wedge the locking latches 156 into the engaged position.

The hose receiver 112 and outlet fluid connector 152 can collectively define a fluid delivery and recovery diverter assembly for selectively switching between on-the-floor and above-the floor cleaning by diverting fluid communication between the motor/fan assembly 18 and either the suction nozzle 16 or the vacuum hose 28, and also diverting liquid communication between the fluid container 34 and either the spray bar 88 or vacuum hose 28. The configuration of the hose receiver 112 and outlet fluid connector 152, and the corresponding inlet airflow connector 148 and inlet fluid connector 150 on the vacuum hose 28, allow the diversion to be accomplished substantially simultaneously with the insertion or removal of the vacuum hose 28 from the base assembly 62.

The nozzle cover 132 can also perform multiple functions, including sealing hose receiver 112 for the vacuum hose 28 when closed, biasing or camming a suction nozzle 16 away from the base housing 74 for removal of the suction nozzle 16 as it is opened, and acting as a handle for the suction nozzle 16 upon removal of the suction nozzle 16 from the base housing 74.

Figure 11:
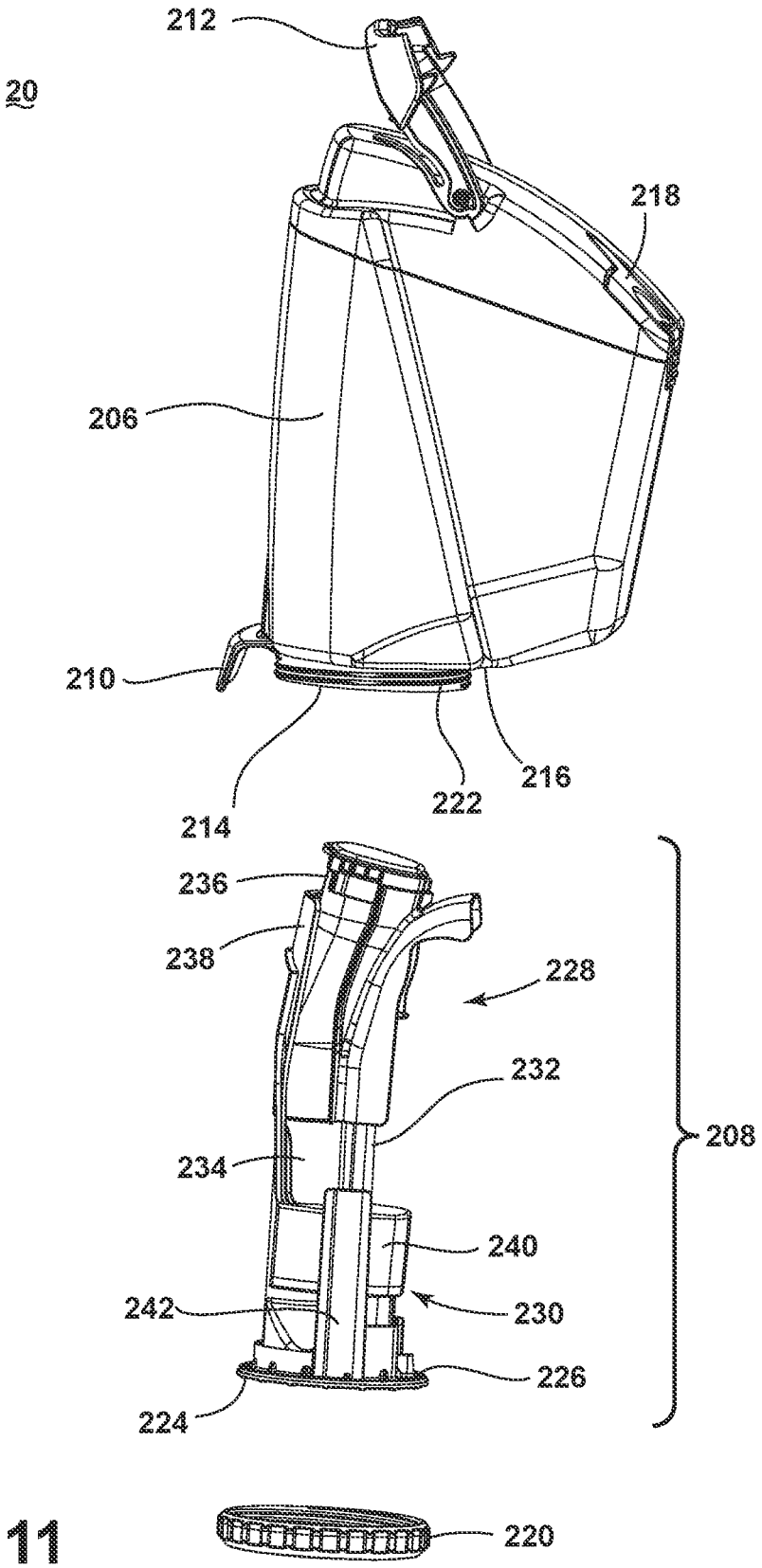
FIG. 11 is a partially exploded, side view of a recovery container of the extraction cleaner of FIG. 2.

FIG. 11 is a partially exploded, side view of the recovery container 20. The recovery container 20 can include a recovery tank 206 defining a recovery chamber and an air/liquid separator assembly 208 within the recovery chamber. At least a portion of the recovery tank 206 can be formed of a transparent or tinted translucent material, which permits a user to view the contents of the recovery tank. A badge 210 can be provided on a front lower portion of the recovery tank 206. A handle 212 can be provided on the recovery tank 206, which facilitates removing and carrying the recovery tank 206. The handle 212 can be pivotally coupled to the recovery tank 206 and can be provided near the top of the tank 206, although other locations are possible.

The recovery tank 206 has an opening 214 through which the air/liquid separator 208 is inserted into and removed from the recovery chamber. The opening 214 can be provided on a bottom wall 216 of the tank 206, such that the air/liquid separator 208 is inserted through the opening 214 and extends upwardly from the bottom wall 216. The recovery tank 206 can be provided with a separate opening for emptying the recovery tank 206, so that the air/liquid separator 208 does not have to be removed every time the recovery tank 206 is emptied. The opening in the illustrated example is provided on an upper portion of the recovery tank 206 and is covered by a removable cover 218.

The air/liquid separator 208 is configured to be easily removable from the recovery tank 206 by a user. This permits the air/liquid separator 208 to be disassembled and cleaned more thoroughly as needed. A coupling between the recovery tank 206 and the air/liquid separator 208 can be provided for facilitating easy separation of the two components. As shown herein, the coupling includes a threaded collar 220 which screws onto a threaded neck 222 on the bottom wall 216 of the recovery tank 206 which defines the opening 214 through which the air/liquid separator 208 is inserted. A flange 224 on the bottom of the air/liquid separator 208 limits insertion of the separator 208 into the tank 206. A seal 226 provides a fluid-tight interface between the recovery tank 206 and the and the air/liquid separator 208 when the air/liquid separator 208 is mounted within the recovery chamber, and also prevents the recovery tank 206 from leaking when removed from the upright assembly 60.

The air/liquid separator 208 includes a stack 228 for guiding air and liquid through the recovery tank 206 and a float assembly 230 for selectively closing the suction path through the recovery tank 206. The stack 228 includes an inlet column 232 which receives recovered air and liquid form the suction nozzle 16, and opens into the interior of the recovery tank 206, and an outlet column 234 which passes substantially clean air, and substantially no liquid, to the motor/fan assembly 18 (FIG. 3) and includes an air inlet port at an upper end of the column 234.

The float assembly 230 includes float shutter 238 and a float body 240 coupled with the float shutter 238 for selectively raising the float shutter 238 to a closed position in which the float shutter 238 closes the air inlet port 236 of the outlet column 234. The float shutter 238 slides within a guide passage provided on the stack 228 defined by opposing guide projections 242 which receive the float body 240, with the float body 240 at least partially wrapping around the columns 232, 234. The float body 240 is buoyant, and as the liquid level recovery tank 206 rises, the float body 240 raises the float shutter 238 to close the air inlet port 236 and prevent liquid from exiting the recovery tank 206 and entering the motor/fan assembly 18.

Figure 12:
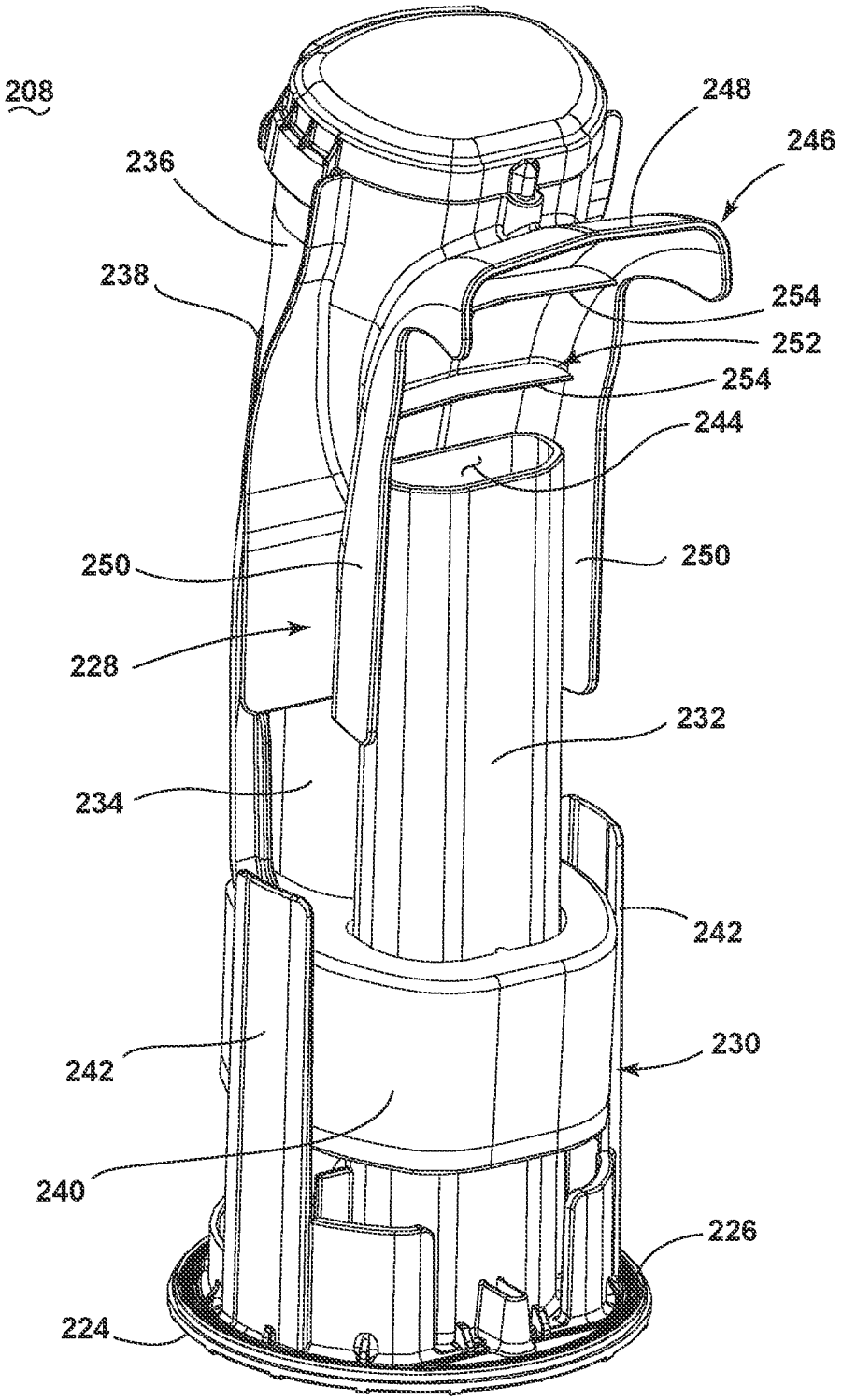
FIG. 12 is a rear perspective view of an air/liquid separator of the recovery container of FIG. 11.

FIG. 12 is a rear perspective view of the air/liquid separator 208. The inlet column 232 includes an open upper end defining an air/liquid outlet port 244 that opens into the interior of the recovery tank 206. A separator shield 246 extends at least partially over or around the outlet port 244 to separate incoming air and liquid. The shield 246 may include a central portion 248 which curves outwardly and over the outlet port 244 and lateral side portions 250 which curve around the sides of the outlet port 244. At least one baffle 252 can also be provided to prevent the full volume of extracted liquid entering the recovery tank 206 from hitting the top of the shield 246 at high speed, thereby reducing the amount of foam and splashing inside the recovery tank 206. As illustrated, the at least one baffle 252 can include multiple ribs 254 on the inner surface of the shield 246 and which project at least partially over the outlet port 244 to interrupt the liquid flow path and slow down the liquid. The ribs 254 can extend between the side portions 250 of the shield 246, partially or completely across the central portion 248.

Figure 13:
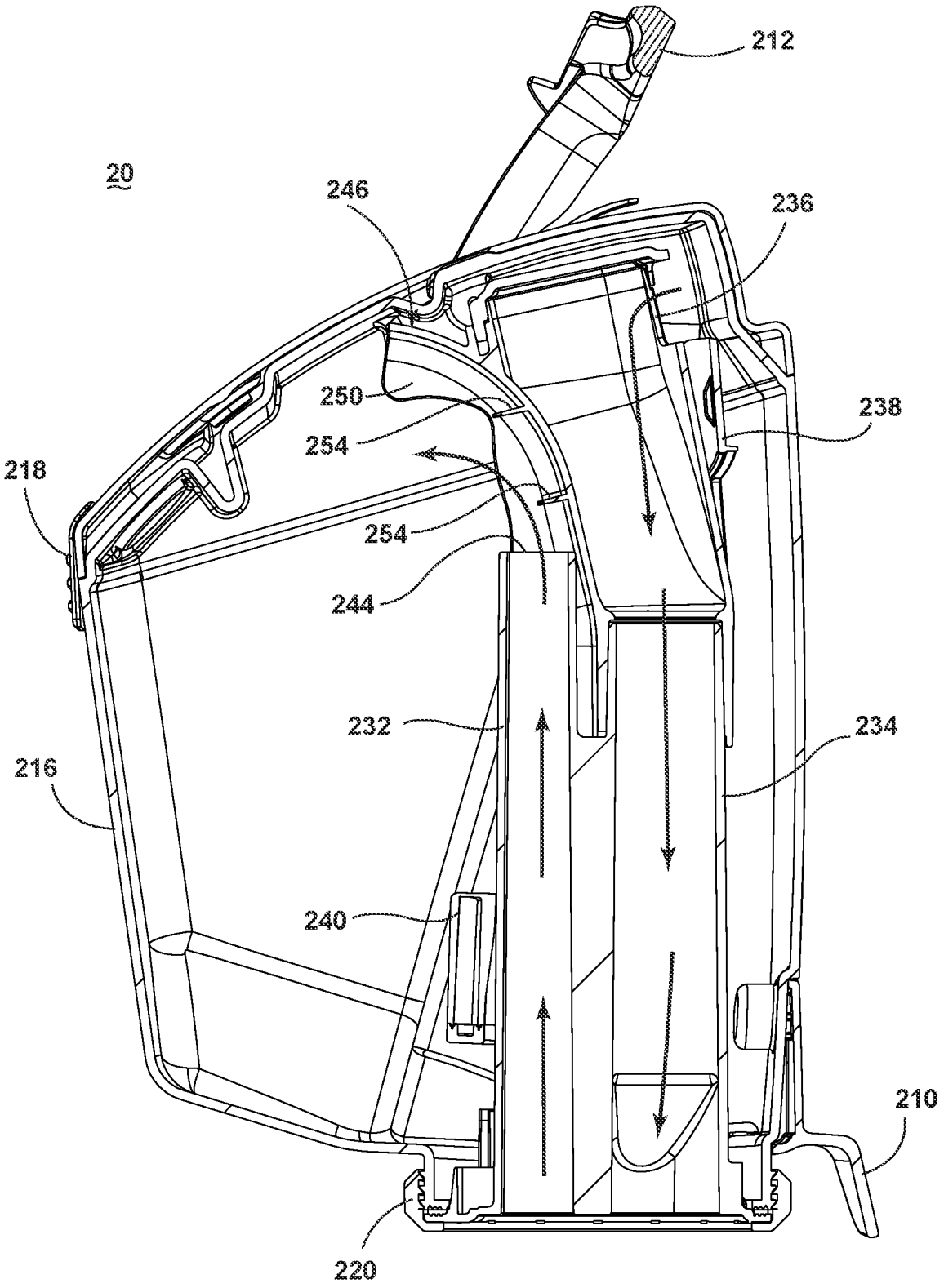
FIG. 13 is a cross-section view of the recovery container of FIG. 11 showing the flow of air and liquid through the recovery container.

FIG. 13 is a cross-section view of the recovery container 20 showing the flow of air and liquid through the recovery container 20 with arrows. Debris-containing fluid, which can contain air and liquid, is drawn into the recovery tank 206, via the inlet column 232 of the stack 228. The debris-containing fluid strikes the separator shield 246, but is first slowed by the ribs 254. Liquid and debris in the fluid then fall under the force of gravity to the bottom of the recovery tank 206. The air drawn into the recovery tank 206, now separated from liquid and debris, is drawn into the outlet column 234.

Figure 14:
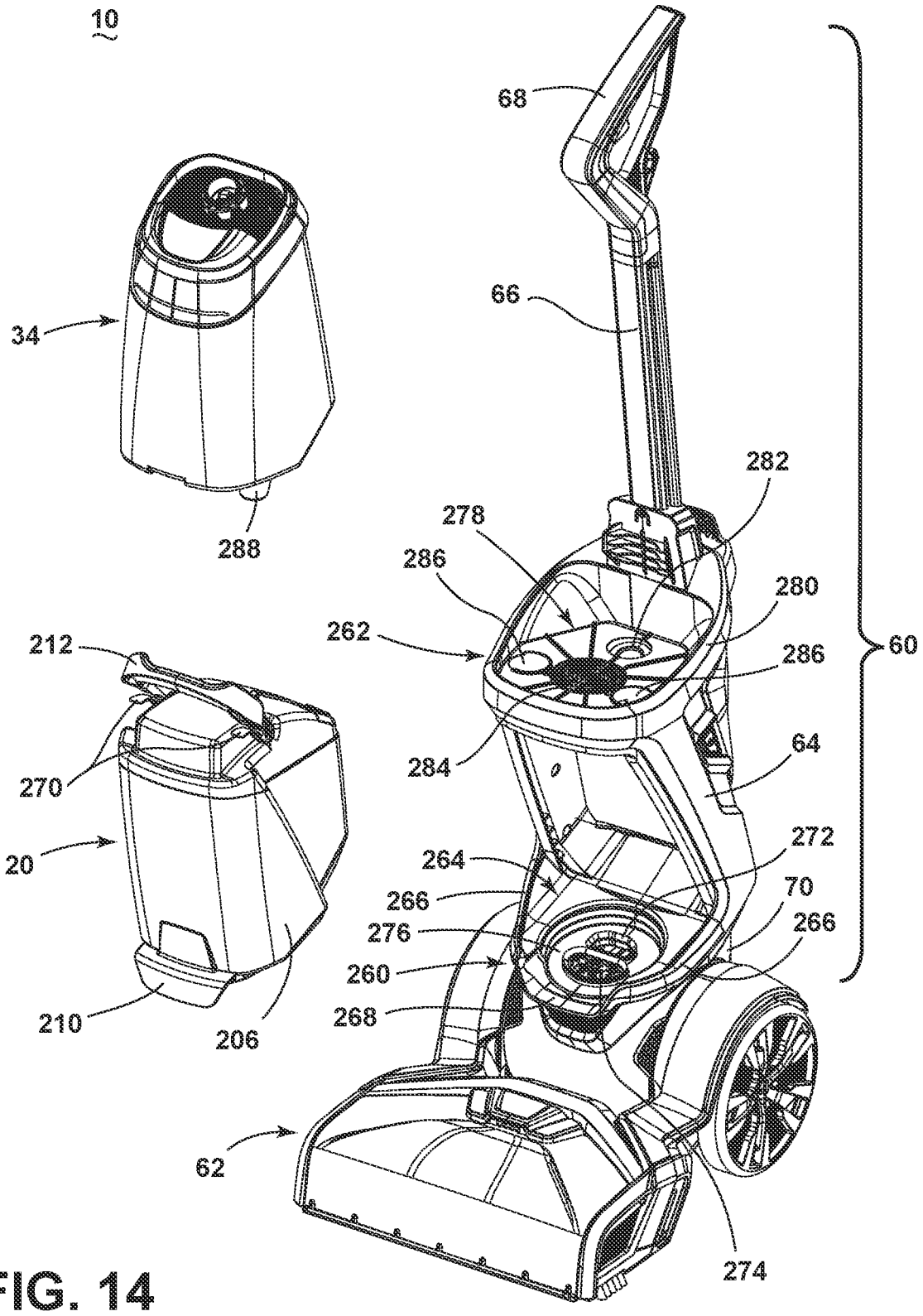
FIG. 14 is a partially exploded view of the extraction cleaner of FIG. 2.

FIG. 14 is a partially exploded view of the extraction cleaner 10. The frame 64 of the upright assembly 60 can include container receivers 260, 262 for respectively receiving the recovery and fluid containers 20, 34 for support on the upright assembly 60. The receivers 260, 262 may further include features for coupling the recovery and fluid containers 20, 34 with the recovery and liquid delivery systems of the extraction cleaner 10.

The recovery container receiver 260 includes a platform 264 that is provided on the frame 64 for supporting the recovery container 20. The platform 264 can be provided above or on top of the motor housing 70. The platform 264 includes upwardly extending lateral sides 266 that nest a lower portion of the recovery container 20, but leaves a majority of the recovery container 20 visible to the user. A front side of the platform 264 is open, and includes a recessed area 268 which accommodates the badge 210 on the recovery container 20. The badge 210 can be provided for aesthetics, but may also aid in properly locating the recovery container 20 on the platform 264. The recovery tank container can have a molded recovery tank 206, which can include integrally molded features that nest the recovery container 20 within the frame 64, and provide further support and stability to the recovery container 20 when mounted to the upright assembly 60. The handle 212 can include a biasing mechanism 270 for biasing the handle 212 upwardly toward a portion of the frame 64 to secure the recovery container 20 within the frame 64. To remove the recovery container 20, the handle 212 is pushed downwardly to disengage from the frame 64.

The recovery container receiver 260 further includes a recovery conduit outlet 272 and a motor conduit inlet 274 that are formed in the platform 264 for fluidly coupling with an inlet and an outlet, respectively, of the recovery container 20 when the recovery container 20 is seated within the recovery container receiver 260. The recovery container receiver 260 further includes a recessed region 276 in which the outlet 272 and inlet 274 are formed. The recessed region 276 accommodates the collar 220 and neck 222 (FIG. 11) of the recovery container 20 and provides lateral stability to the recovery container 20 when mounted to the recovery container receiver 260.

The fluid container receiver 262 includes a platform 278 that is provided on the frame 64 for supporting the fluid container 34. The platform 278 includes an upwardly extending perimeter 280 that nests a lower portion of the fluid container 34, but leaves a majority of the fluid container 34 visible to the user. The fluid container receiver 262 further includes a flow control valve having a valve seat 282 formed in the platform 278 for fluidly coupling with a valve assembly (not shown) of the fluid container 34 when the fluid container 34 is seated within the fluid container receiver 262. Vent-holes 284 can be provided on the platform 278 to release heat generated by the motor cooling air, which is exhausted from the motor/fan assembly 18 and directed to the vent-holes 284 from the motor housing 70 by ducting within the frame 64. The fluid container receiver 262 further includes recesses 286 that receive projections 288 on the bottom of the fluid container 34 and provide lateral stability to the fluid container 34 when mounted to the fluid container receiver 262.

In the example illustrated herein, the platforms 264, 278 are configured to support the recovery container 20 and the fluid container 34 in a stacked arrangement, with the second platform 278 being located generally above the first platform 264 to support the fluid container 34 above the recovery container 20. Other arrangements for the recovery and fluid containers 20, 34 are possible in other examples.

Figure 15:
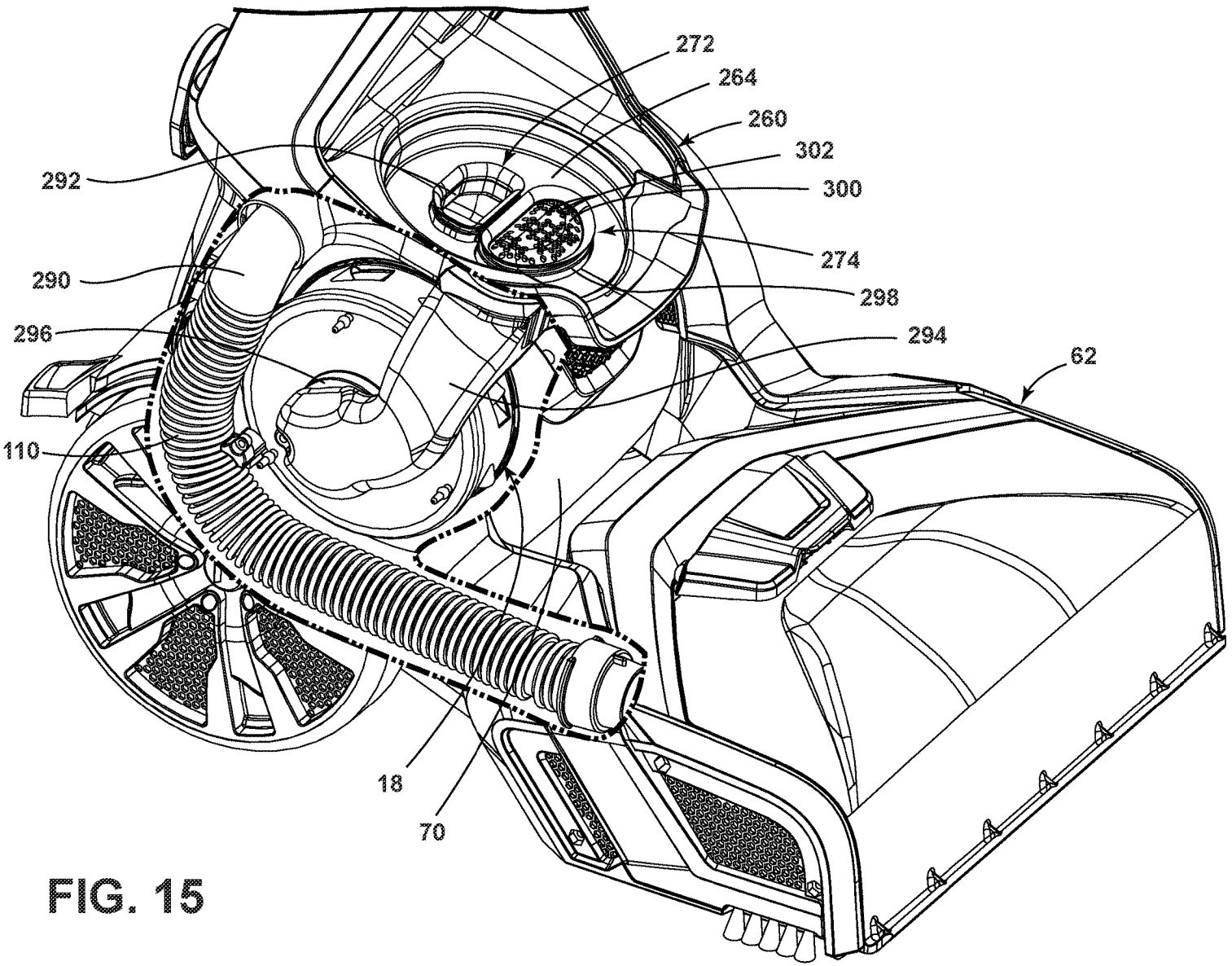
FIG. 15 is a close-up view of a motor housing of the extraction cleaner of FIG. 2, with portions cut away to show some internal features of the extraction cleaner.

FIG. 15 is a close-up view of the motor housing 70 of the extraction cleaner 10, with portions cut away to show some internal features of the extraction cleaner 10. The airflow conduit in fluid communication with the suction nozzle in the base assembly 62 (FIG. 4) may extend into the upright housing assembly 12, and may terminate at the recovery conduit outlet 272 of the recovery container receiver 260. In particular, the airflow conduit can include a rigid duct 290 extending from the recovery airflow conduit underneath the platform 264, and which couples with the flexible hose conduit 110, which extends from the base housing 74 and through the motor housing 70 to reach the duct 290. A seal 292 can be provided at the recovery conduit outlet 272 to provide a fluid-tight coupling with the recovery container 20.

The motor conduit inlet 274 of the recovery container receiver 260 is in fluid communication with the motor/fan assembly 18 via a motor airflow conduit 294. The motor airflow conduit 294 may be made up of one or more flexible and/or rigid sections, and is shown herein as rigid duct extending between the motor conduit inlet 274 and an inlet 296 of the motor/fan assembly 18. A seal 298 can be provided at the motor conduit inlet 274 to provide a fluid-tight coupling with the recovery container 20.

A screen 300 can be provided at the motor conduit inlet 274 to prevent debris of a predetermined size from entering the motor airflow conduit 294 and reaching the motor/fan assembly 18. The screen 300 can include a plurality of openings 302 through which the working air from the recovery container 20 may pass, but which filter out debris of a predetermined size.

The motor conduit inlet 274, and accordingly the screen 300, is located toward the front of the extraction cleaner 10. The motor conduit inlet 274 may be located in front of the recovery conduit outlet 272, near the forward edge of the platform 264. When the recovery container 20 is removed from the upright assembly 60, the screen 300 is exposed, as shown in FIG. 14. This configuration makes the screen 300 highly visible to the user, who can easily assess whether the screen 300 needs cleaning, and easily access the screen 300 for cleaning as needed. Previous extraction cleaners have included a screen within the recovery tank itself. In this location, the screen is not immediately visible to user and therefore the user often does not notice when it requires cleaning. Further, the screen is difficult to access since the recovery tank has to be disassembled to do so.

While the various examples illustrated herein show an upright extraction cleaner, for example FIG. 2, aspects of the disclosure may be used on other types of extraction cleaners, including, but not limited to, a canister device having a cleaning implement connected to a wheeled base by a vacuum hose, a portable extractor adapted to be hand carried by a user for cleaning relatively small areas, or a commercial extractor. For example, any of the illustrated examples can be combined with an extraction cleaner as generally outlined with respect to FIG. 1. Still further, aspects of the disclosure may also be used on surface cleaning apparatus other than extraction cleaners, such as a vacuum cleaner or steam cleaner. A vacuum cleaner typically does not deliver or extract liquid, but rather is used for collecting relatively dry debris (which may include dirt, dust, stains, soil, hair, and other debris) from a surface. A steam cleaner generates steam for delivery to the surface to be cleaned, either directly or via cleaning pad. Some steam cleaners collect liquid in the pad, or may extract liquid using suction force.

The disclosed embodiments are representative of preferred forms of the disclosure and are intended to be illustrative rather than definitive of the disclosure. To the extent not already described, the different features and structures of the various embodiments may be used in combination with each other as desired. That one feature may not be illustrated in all of the embodiments is not meant to be construed that it may not be, but is done for brevity of description. Thus, the various features of the different embodiments may be mixed and matched as desired to form new embodiments, whether or not the new embodiments are expressly described. Reasonable variation and modification are possible within the forgoing disclosure and drawings without departing from the scope of the invention which is defined by the appended claims.

What is claimed is:

1. A vacuum hose for an extraction cleaner, wherein the extraction cleaner includes a fluid supply conduit in fluid communication with a fluid supply tank, a recovery tank, a suction nozzle carried on a base assembly and in fluid communication with the recovery tank, and a suction source in fluid communication with the suction nozzle and the recovery tank, wherein the base assembly includes a hose receiver having a hose port in fluid communication with the suction nozzle and an outlet fluid connector in fluid communication with the fluid supply conduit, the vacuum hose comprising:

a flexible hose conduit having a first end and a second end spaced from the first end, the flexible hose conduit including a hose airflow conduit configured for coupling with the suction source and a hose fluid delivery conduit configured for coupling with the fluid supply conduit; and a hose coupler at the first end of the flexible hose conduit, the hose coupler including an inlet airflow connector in fluid communication with the hose airflow conduit and an inlet fluid connector in fluid communication with the hose fluid delivery conduit, the hose coupler being configured for connecting both the inlet airflow connector to the hose port and the inlet fluid connector to the outlet fluid connector through the suction nozzle;

wherein the hose coupler includes a latch that engages a latch retainer on the suction nozzle to secure the vacuum hose to the base assembly.

2. The vacuum hose of claim 1, wherein the hose coupler includes a housing that includes the inlet airflow connector of the hose airflow conduit and the inlet fluid connector of the hose fluid delivery conduit.

3. The vacuum hose of claim 2, wherein the inlet airflow connector and the inlet fluid connector extend from a distal end of the housing.

4. The vacuum hose of claim 3, wherein the inlet airflow connector is generally centrally located along the distal end of the housing and the inlet fluid connector is located beside the inlet airflow connector.

5. The vacuum hose of claim 1, wherein the hose receiver, the outlet fluid connector, the inlet airflow connector and the inlet fluid connector are configured so as to allow substantially simultaneous coupling of the inlet airflow connector with the hose receiver and the inlet fluid connector with the outlet fluid connector.

6. The vacuum hose of claim 1, wherein the inlet airflow connector and the inlet fluid connector are adjacent to one another.

7. The vacuum hose of claim 1, wherein the vacuum hose further includes a tool coupler at the second end of the flexible hose conduit, the tool coupler being configured for coupling with an accessory tool.

8. An extraction cleaner, comprising:

a base assembly adapted for movement across a surface to be cleaned;

an upright assembly pivotably connected to the base assembly for directing the base assembly across the surface to be cleaned;

a fluid delivery system including a fluid supply conduit in fluid communication with a fluid supply tank;

a fluid recovery system including a suction nozzle carried on the base assembly and in fluid communication with a recovery tank and a suction source in fluid communication with the suction nozzle and the recovery tank; and a hose receiver having a hose port in fluid communication with the suction nozzle, an outlet fluid connector adjacent to the hose port and in fluid communication with the fluid supply conduit, and a nozzle cover pivotable between a closed position, in which the nozzle cover seals the hose port, and an open position, in which the nozzle cover permits insertion of an inlet airflow connector and an inlet fluid connector of a vacuum hose into the hose port;

wherein the hose port is removable with the suction nozzle.

9. An extraction cleaner, comprising:

a base assembly adapted for movement across a surface to be cleaned;

an upright assembly pivotably connected to the base assembly for directing the base assembly across the surface to be cleaned;

a fluid delivery system including a fluid supply conduit in fluid communication with a fluid supply tank;

a fluid recovery system including a suction nozzle carried on the base assembly and in fluid communication with a recovery tank and a suction source in fluid communication with the suction nozzle and the recovery tank; and a hose receiver having a hose port in fluid communication with the suction nozzle, an outlet fluid connector adjacent to the hose port and in fluid communication with the fluid supply conduit, and a nozzle cover pivotable between a closed position, in which the nozzle cover seals the hose port, and an open position, in which the nozzle cover permits insertion of an inlet airflow connector and an inlet fluid connector of a vacuum hose into the hose port;

wherein the hose port is formed in a front wall of the suction nozzle and a sidewall of the hose receiver and an outlet of the hose receiver is formed with a rear wall of the suction nozzle.

10. The extraction cleaner of claim 9, wherein the base assembly further includes a duct, wherein the duct includes an inlet opening that is sealed with the outlet of the hose receiver by a seal for a fluid-tight interface therebetween, and an outlet opening defined by a coupler for a hose conduit.

11. The extraction cleaner of claim 8, wherein a seal is provided between the nozzle cover and the suction nozzle to provide a fluid-tight interface therebetween.

12. The extraction cleaner of claim 8, wherein the hose receiver is in selective fluid communication with the suction nozzle and the vacuum hose, and the outlet fluid connector is in fluid communication with the fluid supply tank.

13. The extraction cleaner of claim 8, wherein the hose port and the hose receiver are configured to receive an inlet airflow connector of a vacuum hose therein and the outlet fluid connector is configured to receive an inlet fluid connector of a vacuum hose therein.

14. The extraction cleaner of claim 8, wherein the hose receiver has a nozzle port in fluid communication with the suction nozzle and an outlet in selective communication with the nozzle port and the hose port, wherein when an inlet airflow connector of a vacuum hose is inserted into the hose receiver through the hose port, the inlet airflow connector blocks the nozzle port and closes off the suction nozzle from fluid communication with the suction source.

15. An extraction cleaner, comprising:

a base assembly adapted for movement across a surface to be cleaned;

an upright assembly pivotably connected to the base assembly for directing the base assembly across the surface to be cleaned;

a fluid delivery system including a fluid supply conduit in fluid communication with a fluid supply tank;

a fluid recovery system including a suction nozzle carried on the base assembly and in fluid communication with a recovery tank and a suction source in fluid communication with the suction nozzle and the recovery tank;

a hose receiver having a hose port in fluid communication with the suction nozzle, an outlet fluid connector adjacent to the hose port and in fluid communication with the fluid supply conduit, and a nozzle cover pivotable between a closed position, in which the nozzle cover seals the hose port, and an open position, in which the nozzle cover permits insertion of an inlet airflow connector and an inlet fluid connector of a vacuum hose into the hose port; and a vacuum hose, wherein the vacuum hose comprises:

a flexible hose conduit including a hose airflow conduit configured for coupling with the suction source and a hose fluid delivery conduit configured for coupling with the fluid supply conduit; and a hose coupler at an end of the flexible hose conduit, the hose coupler including an inlet airflow connector in fluid communication with the hose airflow conduit and an inlet fluid connector in fluid communication with the hose fluid delivery conduit, the hose coupler being configured for connecting both the inlet airflow connector to the hose port and the inlet fluid connector to the outlet fluid connector through the suction nozzle.

16. The extraction cleaner of claim 15, wherein the outlet fluid connector includes a normally-closed valve that is selectively opened by the inlet fluid connector when the vacuum hose is connected to the base assembly.

17. The extraction cleaner of claim 15, wherein the hose receiver, the outlet fluid connector, the inlet airflow connector and the inlet fluid connector are configured so as to allow diversion of fluid communication between the suction source and either the suction nozzle or the vacuum hose and of liquid communication between the fluid supply tank and either a spray bar or the vacuum hose to be accomplished substantially simultaneously with insertion of the vacuum hose into the base assembly or removal of the vacuum hose from the base assembly.

18. The extraction cleaner of claim 15, wherein the hose receiver, the outlet fluid connector, the inlet airflow connector and the inlet fluid connector are configured so as to allow substantially simultaneous coupling of the inlet airflow connector with the hose receiver and the inlet fluid connector with the outlet fluid connector.

19. The extraction cleaner of claim 15, wherein the hose coupler includes a latch that engages a latch retainer on the suction nozzle to secure the vacuum hose to the base assembly.

* * * * *